US011819895B2

(12) United States Patent
Itoh

(10) Patent No.: US 11,819,895 B2
(45) Date of Patent: Nov. 21, 2023

(54) CONTROL SYSTEM, CONTROL METHOD, CONTROL DEVICE, AND PROGRAM

(71) Applicant: NIPPON STEEL CORPORATION, Tokyo (JP)

(72) Inventor: Naruaki Itoh, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 142 days.

(21) Appl. No.: 17/285,844

(22) PCT Filed: Oct. 30, 2019

(86) PCT No.: PCT/JP2019/042646
§ 371 (c)(1),
(2) Date: Apr. 15, 2021

(87) PCT Pub. No.: WO2020/090921
PCT Pub. Date: May 7, 2020

(65) Prior Publication Data

US 2021/0379636 A1 Dec. 9, 2021

(30) Foreign Application Priority Data

Oct. 31, 2018 (JP) ..... 2018-205622

(51) Int. Cl.
*B21B 37/46* (2006.01)
*B21B 37/16* (2006.01)
(Continued)

(52) U.S. Cl.
CPC ..... *B21B 37/165* (2013.01); *B21B 1/463* (2013.01); *B21B 37/46* (2013.01); *B21B 37/50* (2013.01);
(Continued)

(58) Field of Classification Search
CPC . B22D 11/1206; B22D 11/16; B22D 11/0622; B22D 11/0682; B21B 1/463;
(Continued)

(56) References Cited

U.S. PATENT DOCUMENTS 4,658,882 A * 4/1987 Oba ..... B21B 1/466 164/444
7,849,722 B2 * 12/2010 Britanik ..... B21B 37/28 72/11.8
(Continued)

FOREIGN PATENT DOCUMENTS

| | | |
|---|---|---|
| CN | 101274334 A | 10/2008 |
| JP | 5-15921 A | 1/1993 |
| JP | 2014-58001 A | 4/2014 |

*Primary Examiner* — Edward T Tolan
(74) *Attorney, Agent, or Firm* — Birch, Stewart, Kolasch & Birch, LLP

(57) ABSTRACT

A control system is a control system of casting and rolling equipment having a twin roll-type continuous casting machine, a rolling mill, and a conveyor. The control system includes a rolling mill control unit that controls the rolling mill by any one of controls including a rolling control and an open control, a conveyor control unit that controls the conveyor by any one of controls including a tension control and a speed control, a first control unit that controls to perform the rolling control and the tension control, a second control unit that controls to perform the open control and the speed control, and a third control unit that controls to resume the tension control and the rolling control.

7 Claims, 10 Drawing Sheets

(51) Int. Cl.

| | |
|---|---|
| ***B21B 1/46*** | (2006.01) |
| ***B21B 37/50*** | (2006.01) |
| ***B21B 38/04*** | (2006.01) |
| ***B22D 11/06*** | (2006.01) |

(52) U.S. Cl.
CPC ..... *B21B 38/04* (2013.01); *B22D 11/0622* (2013.01); *B22D 11/0682* (2013.01)

(58) Field of Classification Search
CPC ..... B21B 37/165; B21B 37/46; B21B 37/58; B21B 37/62; B21B 38/04; B21B 37/50
See application file for complete search history.

(56) References Cited

U.S. PATENT DOCUMENTS

| | | | | |
|---|---|---|---|---|
| 7,963,136 | B2 * | 6/2011 | Flick | B21B 37/28 72/200 |
| 7,987,896 | B2 * | 8/2011 | Schmidt | B22D 11/1206 164/451 |
| 9,855,598 | B2 * | 1/2018 | Winter | B22D 11/0622 |
| 10,281,502 | B2 * | 5/2019 | Kuo | G01R 19/16519 |
| 2007/0220939 | A1 * | 9/2007 | Britanik | B21B 37/28 72/9.2 |
| 2010/0252223 | A1 * | 10/2010 | Franz | B22D 11/1284 164/269 |
| 2015/0144288 | A1 * | 5/2015 | Eichholz | B22D 11/041 164/424 |

* cited by examiner

CONTROL SYSTEM, CONTROL METHOD, CONTROL DEVICE, AND PROGRAM

TECHNICAL FIELD OF THE INVENTION

The present invention relates to a control system, a control method, a control device, and a program.

The present application claims priority based on Japanese Patent Application No. 2018-205622 filed in Japan on Oct. 31, 2018, the contents of which are incorporated herein by reference.

RELATED ART

A rolling mill having a rolling roll has been conventionally used to roll a material to be rolled such as a steel sheet. In this regard, Patent Document 1 discloses a technique of opening and closing a rolling roll by performing a first control and a second control. The first control is a control for opening the rolling roll. In the first control, the control is performed such that the rolling roll is in a non-contact state with the material from a state of being closed to the material to be rolled in a state where the material to be rolled in a rolled state is decelerated from a speed at a time of rolling to an extremely low speed and tension of the material to be rolled on an inlet side and an exit side of the rolling mill is equal to each other. The second control is a control for closing the rolling roll. In the second control, the control is performed such that the rolling roll is closed from an open state that is in non-contact with the material to be rolled and then is accelerated to a speed during normal rolling in a state where the speed of the material to be rolled is in an extremely low speed, which is lower than the speed during normal rolling, and in a state where another predetermined condition is satisfied.

PRIOR ART DOCUMENT

Patent Document

[Patent Document 1] Japanese Unexamined Patent Application, First Publication No. 2014-58001

DISCLOSURE OF THE INVENTION

Problems to be Solved by the Invention

By the way, there is a case where the material to be rolled that is conveyed to the rolling mill has an abnormality such as a hot band or meandering. The rolling may not be performed normally when the rolling is continued in a case where the material to be rolled that is conveyed to the rolling mill has the abnormality. Therefore, it is necessary to open the rolling roll.

However, when the rolling roll is suddenly open in a state where a tension control is performed in which predetermined tension is applied to the material to be rolled, torque of a motor that rotates a pinch roll suddenly fluctuates. The material to be rolled slips against the pinch roll and the pinch roll defects. Therefore, unsteady work such as adjustment and replacement of the pinch roll is required, and a time during which the rolling cannot be performed increases. When the state where the material to be rolled continues to slip against the pinch roll, the predetermined tension cannot be applied to the material to be rolled and a state where the material to be rolled cannot be rolled normally continues. Patent Document 1 does not describe the control in a case where there is the abnormality in the material to be rolled that is conveyed to the rolling mill.

An object of the present invention is to make it possible to continue the rolling stably.

Means for Solving the Problem

The outline of the present invention is as follows.

(1) A first aspect of the present invention is a control system of casting and rolling equipment including a twin roll-type continuous casting machine, a rolling mill that rolls a steel sheet with a pair of rolling rolls, and a conveyor that conveys the steel sheet in a direction of the rolling mill with a pair of conveyance rolls, in which the twin roll-type continuous casting machine includes a pair of casting rolls that rotate in directions opposite to each other, the pair of the casting rolls cools molten steel injected into an upper pouring basin between the pair of the casting rolls and pressure-contacts the cooled and solidified molten steel to discharge the steel sheet from between the pair of the casting rolls, and the conveyor conveys the steel sheet discharged from the twin roll-type continuous casting machine in the direction of the rolling mill. The control system includes a rolling mill control unit that controls the rolling mill by any one of controls including a rolling control of rolling the steel sheet with a set roll gap and an open control that performs a control such that at least one of the pair of the rolling rolls does not contact the steel sheet, a conveyor control unit that controls the conveyor by any one of controls including a tension control that conveys the steel sheet at set tension of the steel sheet and a speed control that conveys the steel sheet at a set rotation speed of the conveyance rolls, a first control unit that controls the rolling mill control unit to perform the rolling control and controls the conveyor control unit to perform the tension control, a second control unit that controls the rolling mill control unit to perform the open control and controls the conveyor control unit to perform the speed control in a case where determination is made that there is an abnormality in the steel sheet while the rolling control and the tension control started by the control by the first control unit are performed, and a third control unit that controls the conveyor control unit to resume the tension control and controls the rolling mill control unit to resume the rolling control in a case where determination is made that the conveyance rolls are stabilized at the set rotation speed by the speed control started by the control by the second control unit.

(2) In the control system according to (1), the rolling mill control unit may control the rolling mill by any one of controls including the rolling control, the open control, and a light reduction control that lightly reduces the steel sheet with a roll gap larger than the set roll gap. The third control unit may control the rolling mill control unit to perform the light reduction control, then control the conveyor control unit to resume the tension control, and then control the rolling mill control unit to resume the rolling control, in a case where determination is made that the pair of conveyance rolls are stabilized at the set rotation speed by the speed control started by the control by the second control unit.

(3) In the control system according to (2), the third control unit may control the rolling mill control unit to perform the light reduction control, then control the conveyor control unit to resume the tension control, and then control the rolling mill control unit to resume the rolling control in a case where determination is made such that there is no abnormality in the steel sheet, in a case where determination is made that the pair of conveyance rolls is stabilized at the set rotation speed by the speed control started by the control of the second control unit. The second control unit may control the rolling mill control unit to perform the open control and controls the conveyor control unit to perform the speed control, in a case where a determination is made that there is an abnormality in the steel sheet after the tension control is resumed by the control of the third control unit or in a case where determination is made that there is an abnormality in the steel sheet while the rolling control and the tension control started by the control of the first control unit are performed.

(4) In the control system according to (1), an abnormality determination unit that determines that there is the abnormality in the steel sheet in a case where determination is made that the steel sheet meanders or a case where determination is made that there is an abnormal sheet thickness fluctuation in the steel sheet or a combination thereof is further included. The second control unit may control the rolling mill control unit to perform the open control and controls the conveyor control unit to perform the speed control, in a case where the abnormality determination unit determines that there is the abnormality in the steel sheet while the rolling control and the tension control started by the control by the first control unit are performed.

(5) In the control system according to (4), the abnormality determination unit may determine whether or not the abnormal sheet thickness fluctuation occurs in the steel sheet based on a current of a motor that rotates the rolling roll.

(6) In the control system according to (1), a speed determination unit that determines that the conveyance rolls are stabilized at the set rotation speed in a case where the rotation speed of the conveyance rolls continuously falls in a set range for a set time is further included. The third control unit may control the conveyor control unit to resume the tension control and controls the rolling mill control unit to resume the rolling control, in a case where the speed determination unit determines that the conveyance rolls are stabilized at the set rotation speed after the speed control is started by the control by the second control unit.

(7) A second aspect of the present invention is a control method of casting and rolling equipment including a twin roll-type continuous casting machine, a rolling mill that rolls a steel sheet with a pair of rolling rolls, a conveyor that conveys the steel sheet in a direction of the rolling mill with a pair of conveyance rolls, a rolling mill control unit that controls the rolling mill by any one of controls including a rolling control of rolling the steel sheet with a set roll gap and an open control that performs a control such that at least one of the pair of the rolling rolls does not contact the steel sheet, a conveyor control unit that controls the conveyor by any one of controls including a tension control that conveys the steel sheet at set tension of the steel sheet and a speed control that conveys the steel sheet at a set rotation speed of the conveyance rolls, in which the twin roll-type continuous casting machine includes a pair of casting rolls that rotates in directions opposite to each other, the pair of the casting rolls cools molten steel injected into an upper pouring basin between the pair of the casting rolls and pressure-contacts the cooled and solidified molten steel to discharge the steel sheet from between the pair of the casting rolls, and the conveyor conveys the steel sheet discharged from the twin roll-type continuous casting machine in the direction of the rolling mill. The control method includes a first control step of controlling the rolling mill control unit to perform the rolling control and controlling the conveyor control unit to perform the tension control, a second control step of controlling the rolling mill control unit to perform the open control and controlling the conveyor control unit to perform the speed control in a case where determination is made that there is an abnormality in the steel sheet while the rolling control and the tension control started by the control by the first control step are performed, and a third control step of controlling the conveyor control unit to resume the tension control and controlling the rolling mill control unit to resume the rolling control, in a case where determination is made that the conveyance rolls are stabilized at the set rotation speed by the speed control started by the control by the second control step.

(8) A third aspect of the present invention is a control device that controls casting and rolling equipment including a twin roll-type continuous casting machine, a rolling mill that rolls a steel sheet with a pair of rolling rolls, a conveyor that conveys the steel sheet in a direction of the rolling mill with a pair of conveyance rolls, a rolling mill control unit that controls the rolling mill by any one of controls including a rolling control of rolling the steel sheet with a set roll gap and an open control that performs a control such that at least one of the pair of the rolling rolls does not contact the steel sheet, a conveyor control unit that controls the conveyor by any one of controls including a tension control that conveys the steel sheet at set tension of the steel sheet and a speed control that conveys the steel sheet at a set rotation speed of the conveyance rolls, in which the twin roll-type continuous casting machine includes a pair of casting rolls that rotates in directions opposite to each other, the pair of the casting rolls cools molten steel injected into an upper pouring basin between the pair of the casting rolls and pressure-contacts the cooled and solidified molten steel to discharge the steel sheet from between the pair of the casting rolls, and the conveyor conveys the steel sheet discharged from the twin roll-type continuous casting machine in the direction of the rolling mill. The control device includes a first control unit that controls the rolling mill control unit to perform the rolling control and controls the conveyor control unit to perform the tension control, a second control unit that controls the rolling mill control unit to perform the open control and controls the conveyor control unit to perform the speed control in a case where determination is made that there is an abnormality in the steel sheet while the rolling control and the tension control started by the control by the first control unit are performed, and a third control unit that controls the conveyor control unit to resume the tension control and controls the rolling mill control unit to resume the rolling control in a case where determination is made that the conveyance rolls are stabilized at the set rotation speed by the speed control started by the control by the second control unit.

(9) A fourth aspect of the present invention is a program that controls casting and rolling equipment including a twin roll-type continuous casting machine, a rolling mill that rolls a steel sheet with a pair of rolling rolls, a conveyor that conveys the steel sheet in a direction of the rolling mill with a pair of conveyance rolls, a rolling mill control unit that controls the rolling mill by any one of controls including a rolling control of rolling the steel sheet with a set roll gap and an open control that performs a control such that at least one of the pair of the rolling rolls does not contact the steel sheet, a conveyor control unit that controls the conveyor by any one of controls including a tension control that conveys the steel sheet at set tension of the steel sheet and a speed control that conveys the steel sheet at a set rotation speed of the conveyance rolls, in which the twin roll-type continuous casting machine includes a pair of casting rolls that rotates in directions opposite to each other, the pair of the casting rolls cools molten steel injected into an upper pouring basin between the pair of the casting rolls and pressure-contacts the cooled and solidified molten steel to discharge the steel sheet from between the pair of the casting rolls, and the conveyor conveys the steel sheet discharged from the twin roll-type continuous casting machine in the direction of the rolling mill. The program causing a computer to function as a first control unit that controls the rolling mill control unit to perform the rolling control and controls the conveyor control unit to perform the tension control, a second control unit that controls the rolling mill control unit to perform the open control and controls the conveyor control unit to perform the speed control in a case where determination is made that there is an abnormality in the steel sheet while the rolling control and the tension control started by the control by the first control unit are performed, and a third control unit that controls the conveyor control unit to resume the tension control and controls the rolling mill control unit to resume the rolling control in a case where determination is made that the conveyance rolls are stabilized at the set rotation speed by the speed control started by the control by the second control unit.

EFFECTS OF THE INVENTION

According to the present invention, it is possible to continue the rolling stably.

BRIEF DESCRIPTION OF THE DRAWINGS

FIG. 6 is a diagram showing a rolling motor current graph and the like.

EMBODIMENTS OF THE INVENTION

Overall Configuration

Figure 1:
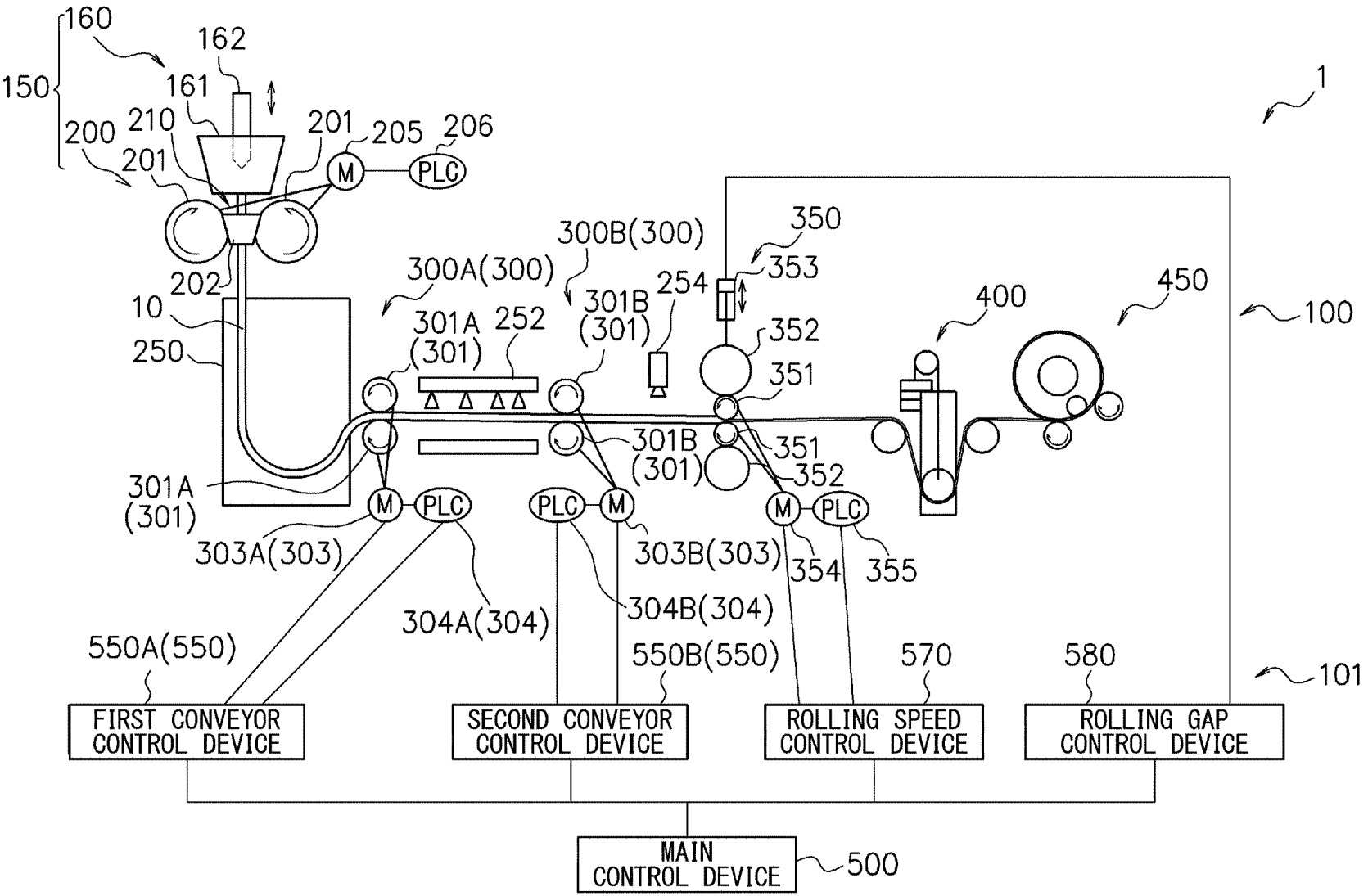
FIG. 1 is a diagram showing an example of a configuration of a casting and rolling system.

First, a casting and rolling system 1 according to the present embodiment will be described with reference to FIG. 1. FIG. 1 is a diagram showing an example of a configuration of the casting and rolling system 1. The casting and rolling system 1 has casting and rolling equipment 100 and a control system 101, and casts and rolls a steel sheet 10 as a material to be rolled. In this embodiment, the bottom is a direction of gravity and the top is an opposite direction of gravity.

The casting and rolling equipment 100 includes a twin roll-type continuous casting machine 150, a processing chamber 250, cooling equipment 252, a meandering meter 254, a conveyor 300, a rolling mill 350, a looper 400, and a coiler 450.

The twin roll-type continuous casting machine 150 is a casting machine that manufactures the steel sheet 10 from molten steel and includes an injection portion 160 and a casting portion 200.

The injection portion 160 is a device for injecting the molten steel into the casting portion 200 and includes a tundish 161 and a stopper 162.

The tundish 161 is a container that temporarily receives the molten steel injected from a ladle. The molten steel injected into the tundish 161 is injected into a pouring basin 210 of the casting portion 200 through a spout which is a through-hole provided in the lower part of the tundish 161.

The stopper 162 is a rod-shaped member that can open and close the spout provided in the lower part of the tundish 161, is disposed above the spout, and elongates in the vertical direction. The stopper 162 moves in the vertical direction and thus an amount of the molten steel injected from the tundish 161 into the casting portion 200 changes. When the stopper 162 moves to the lowermost position to close the spout of the tundish 161, the molten steel is not injected from the tundish 161 into the casting portion 200.

The casting portion 200 manufactures the steel sheet 10 from the molten steel injected from the injection portion 160. The casting portion 200 includes a pair of casting rolls 201, a pair of weirs 202, a casting motor 205, and a casting machine speedometer 206.

Each of the casting rolls of the pair of casting rolls 201 is a columnar roll and is rotatable around a central axis as a rotation axis. The pair of casting rolls 201 has the same shape as each other, and the respective rotation axes are disposed to be substantially parallel on the same horizontal plane. A gap referred to as a casting roll gap is provided between the pair of casting rolls 201. Each of the casting rolls of the pair of casting rolls 201 rotate in directions opposite to each other such that end portions on the casting roll gap side advance downward. A region surrounded by an upper side of the casting roll gap and the weir 202 is the pouring basin 210 in which the molten steel injected from the injection portion 160 is collected.

When each of the casting rolls of the pair of casting rolls 201 rotates in a state where the molten steel is injected into the pouring basin 210, the casting rolls 201 cool and solidify the molten steel on a surface of the casting roll 201. The pair of casting rolls 201 pressure-contacts a solidified shell, which is solidified molten steel, to discharge the steel sheet 10 downward from the casting roll gap.

Each of the weirs of the pair of weirs 202 is provided at both ends of the casting roll 201 in a rotation axis direction and at least above the casting roll gap to prevent the molten steel from spilling from the pouring basin 210 in the rotation axis direction of the casting roll 201.

The casting motor 205 rotates each of the casting rolls of the pair of casting rolls 201.

The casting machine speedometer 206 measures a rotation speed of the casting motor 205. The rotation speed of the casting motor 205 corresponds to a casting roll speed. The casting roll speed is a speed of the surface of the casting roll 201 and is proportional to the rotation speed of the casting motor 205. The casting roll speed represents a rotation speed of the casting roll 201.

The processing chamber 250 is filled with gas to prevent oxidation of the steel sheet 10 discharged from the twin roll-type continuous casting machine 150.

The cooling equipment 252 is disposed between a first conveyor 300A and a second conveyor 300B and cools the steel sheet 10 by spraying cooling water on the steel sheet 10 to be conveyed.

The meandering meter 254 measures an amount of meandering of the steel sheet 10 and outputs the measured amount to a main control device 500. The amount of meandering is an amount representing a difference between a planned normal position of the steel sheet 10 in a direction perpendicular to a conveyance direction of the steel sheet 10 and an actual position of the steel sheet 10 in the direction perpendicular to the conveyance direction of the steel sheet 10 in a case where the steel sheet 10 is viewed from above. The planned normal position is assumed to be set in advance. In this embodiment, the meandering meter 254 is disposed in front of the rolling mill 350. More specifically, the meandering meter 254 is disposed between the second conveyor 300B and the rolling mill 350. However, the meandering meter 254 may be disposed behind the rolling mill 350. More specifically, the meandering meter 254 may be disposed between the rolling mill 350 and the looper 400.

The conveyor 300 pulls in the steel sheet 10 and discharges the steel sheet 10 in the conveyance direction to convey the steel sheet 10. The conveyor 300 includes a pair of pinch rolls 301, a conveyance motor 303, and a conveyor speedometer 304.

Each of the pinch rolls of the pair of pinch rolls 301 is a columnar roll, is rotatable around a central axis as a rotation axis, and is disposed to be side by side vertically. A gap referred to as a pinch roll gap is provided between the pair of pinch rolls 301. The pair of pinch rolls 301 sandwiches the steel sheet 10 by passing the steel sheet 10 through the pinch roll gap and rotates in directions opposite to each other while pressurizing a surface of the steel sheet 10 to convey the steel sheet 10. The pinch roll 301 is also referred to as a conveyance roll.

The conveyance motor 303 rotates each of the pinch rolls of the pair of pinch rolls 301. Torque of the conveyance motor 303 is proportional to a current flowing through the conveyance motor 303.

The conveyor speedometer 304 measures a rotation speed of the conveyance motor 303. The rotation speed of the conveyance motor 303 corresponds to a pinch roll speed. The pinch roll speed is a speed of a surface of the pinch roll 301 and is proportional to the rotation speed of the conveyance motor 303. The pinch roll speed represents a rotation speed of the pinch roll 301.

The casting and rolling equipment 100 includes the first conveyor 300A and the second conveyor 300B as the conveyor 300.

The first conveyor 300A is disposed at a position deviated from the casting roll gap of the twin roll-type continuous casting machine 150 when viewed from above. The first conveyor 300A pulls in the steel sheet 10 discharged from the twin roll-type continuous casting machine 150 and discharges the steel sheet 10 in a direction of the second conveyor 300B to convey the steel sheet 10. The second conveyor 300B pulls in the steel sheet 10 conveyed from the first conveyor 300A and discharges the steel sheet 10 in a direction of the rolling mill 350 to convey the steel sheet 10 to the rolling mill 350.

The pinch roll 301, the conveyance motor 303, the conveyor speedometer 304, and the pinch roll speed of the first conveyor 300A are respectively referred to as a first pinch roll 301A, a first conveyance motor 303A, a first conveyor speedometer 304A, and a first pinch roll speed.

The pinch roll 301, the conveyance motor 303, the conveyor speedometer 304, and the pinch roll speed of the second conveyor 300B are respectively referred to as a second pinch roll 301B, a second conveyance motor 303B, a second conveyor speedometer 304B, and a second pinch roll speed.

The rolling mill 350 rolls the steel sheet 10 conveyed from the second conveyor 300B. The rolling mill 350 rolls the steel sheet 10 while pulling in the steel sheet 10 and discharges the steel sheet 10 in the conveyance direction. The rolling mill 350 includes a pair of rolling rolls 351, a pair of backup rolls 352, a rolling mill power cylinder 353, a rolling motor 354, and a rolling mill speedometer 355.

Each of the rolling rolls of the pair of rolling rolls 351 is a columnar roll, is rotatable around a central axis as a rotation axis, and is disposed vertically side by side such that the respective rotation axes are parallel to each other. A gap referred to as a rolling roll gap is provided between the pair of rolling rolls 351. The pair of rolling rolls 351 sandwiches the steel sheet 10 by passing the steel sheet 10 through the rolling roll gap and rotates in directions opposite to each other while adding force to pressurize the steel sheet 10 to roll the steel sheet 10.

Each of the backup rolls of the pair of backup rolls 352 is a columnar roll, is rotatable about a central axis as a rotation axis, and is disposed to be side by side vertically with the pair of rolling rolls 351 sandwiched therebetween. An upper backup roll 352 is disposed above an upper rolling roll 351 to be in contact with the upper rolling roll 351. A lower backup roll 352 is disposed below a lower rolling roll 351 to be in contact with the lower rolling roll 351.

The rolling mill power cylinder 353 is, for example, a hydraulic servo cylinder and adds the force to the upper backup roll 352 to change the rolling mill pressing force or the rolling roll gap. The conveyor power cylinder 302 applies the rolling mill pressing force to the steel sheet 10 through the upper rolling roll 351. The rolling mill pressing force is force that the rolling roll 351 pressurizes the steel sheet 10 to roll the steel sheet 10.

The rolling motor 354 rotates the pair of rolling rolls 351.

The rolling mill speedometer 355 measures a rotation speed of the rolling motor 354. The rotation speed of the rolling motor 354 corresponds to a rolling roll speed. The rolling roll speed is a speed of a surface of the rolling roll 351 and is proportional to the rotation speed of the rolling motor 354. The rolling roll speed represents a rotation speed of the rolling roll 351.

The looper 400 applies tension to the steel sheet 10. The looper 400 according to the present embodiment is a counter balance weight type looper. The looper 400 is disposed between the rolling mill 350 and the coiler 450.

The coiler 450 pulls in the steel sheet 10 and winds up the steel sheet 10.

The control system 101 controls the casting and rolling equipment 100. The control system 101 includes a main control device 500, a conveyor control device 550, a rolling speed control device 570, and a rolling gap control device 580.

The main control device 500 is an information processing device that controls the conveyor control device 550, the rolling speed control device 570, and the rolling gap control device 580 to control the casting and rolling equipment 100.

The conveyor control device 550 is an information processing device that controls the conveyor 300 based on the control of the main control device 500 to control the pinch roll 301. More specifically, the conveyor control device 550 controls the current of the conveyance motor 303 included in the conveyor 300 to control the pinch roll 301. The control system 101 includes a first conveyor control device 550A and a second conveyor control device 550B as the conveyor control device 550. The first conveyor control device 550A controls the first conveyor 300A. More specifically, the first conveyor control device 550A adjusts a current of the first conveyance motor 303A to control the first pinch roll 301A. The second conveyor control device 550B controls the second conveyor 300B. More specifically, the second conveyor control device 550B adjusts a current of the second conveyance motor 303B to control the second pinch roll 301B. For example, an inverter is used as the conveyor control device 550.

The rolling speed control device 570 is an information processing device that controls the rolling mill 350 based on the control of the main control device 500 to control the rolling roll speed. More specifically, the rolling speed control device 570 controls a current of the rolling motor 354 included in the rolling mill 350 to control the rolling roll speed. For example, an inverter is used as the rolling speed control device 570.

The rolling gap control device 580 is an information processing device that controls the rolling mill 350 based on the control of the main control device 500 to control the rolling roll gap. More specifically, the rolling gap control device 580 controls the rolling mill power cylinder 353 included in the rolling mill 350 to control the rolling roll gap. The rolling gap control device 580 is also referred to as a rolling mill control device.

Next, a conveyance path of the steel sheet 10 in the casting and rolling equipment 100 will be described. First, the steel sheet 10 is discharged from between the pair of casting rolls 201 of the twin roll-type continuous casting machine 150. Next, the steel sheet 10 passes between the pair of first pinch rolls 301A included in the first conveyor 300A and between the pair of second pinch rolls 301B included in the second conveyor 300B. The steel sheet 10 is rolled between the pair of rolling rolls 351 of the rolling mill 350 and discharged to the looper 400. Next, the steel sheet 10 passes through the looper 400 and is wound by the coiler 450.

Hardware Configuration

Figure 2A:
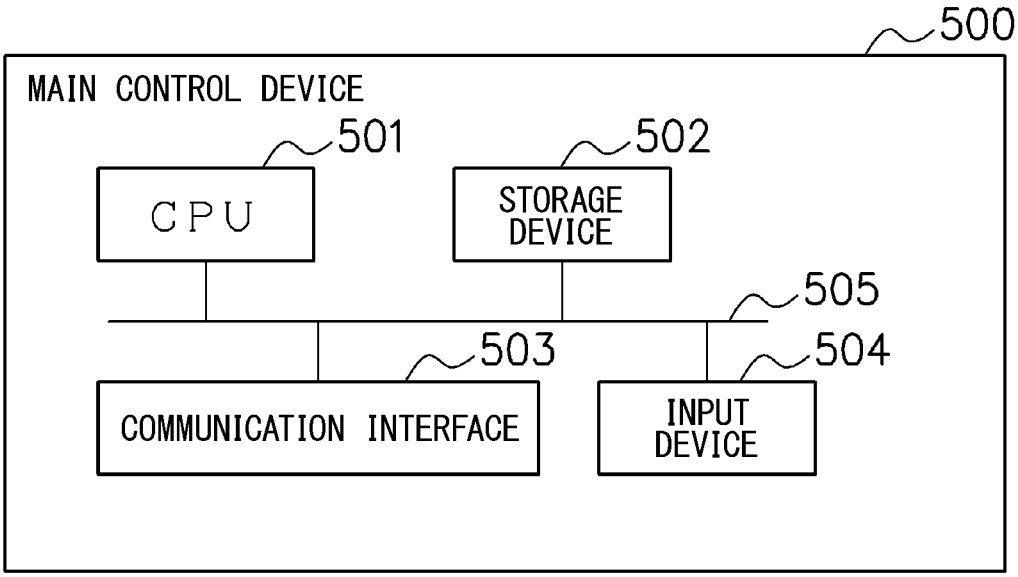
FIG. 2A is a diagram showing an example of a hardware configuration of a main control device.

Next, a hardware configuration of the main control device 500 will be described with reference to FIG. 2A. FIG. 2A is a diagram showing an example of the hardware configuration of the main control device 500.

The main control device 500 is a computer such as a programmable logic controller (PLC) and includes a CPU 501, a storage device 502, a communication interface 503, an input device 504, and a bus 505 connecting them.

The CPU 501 controls the entire main control device 500. The CPU 501 executes processing based on a program stored in the storage device 502 or the like to realize a function of the main control device 500 shown in FIG. 3 or processing of FIG. 9.

The storage device 502 is a storage medium such as a RAM, a ROM, or an HDD, and stores the program or temporarily stores data used by the CPU 501.

The communication interface 503 controls communication between the main control device 500 and the conveyor control device 550, the rolling speed control device 570, or the rolling gap control device 580.

The input device 504 receives an input from an operator. Various switches or buttons, a touch panel, a keyboard, a mouse, or the like are used as the input device 504.

The main control device 500 has a function of virtually dividing the CPU 501 and can perform parallel processing. The CPU 501 can acquire information of a measuring instrument of the casting and rolling equipment 100 through the communication interface 503. The measuring instrument of the casting and rolling equipment 100 is a device for acquiring various pieces of information of the casting and rolling equipment 100 and includes the meandering meter 254 and the speedometer such as the casting machine speedometer 206 or the rolling mill speedometer 355.

Figure 2B:
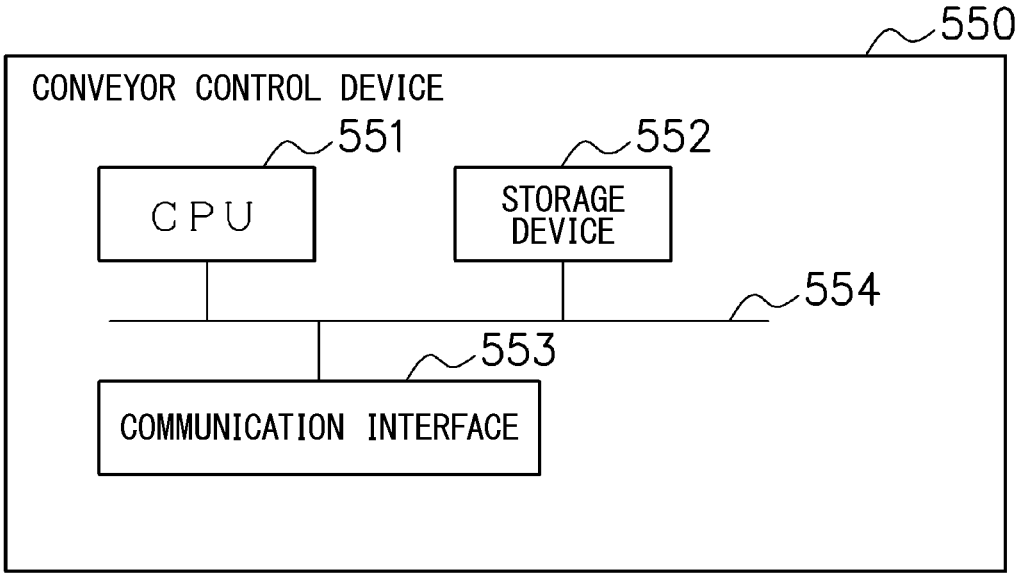
FIG. 2B is a diagram showing an example of a hardware configuration of a conveyor control device.

Next, a hardware configuration of the conveyor control device 550 will be described with reference to FIG. 2B. FIG. 2B is a diagram showing an example of the hardware configuration of the conveyor control device 550.

The conveyor control device 550 is a computer such as an inverter and includes a CPU 551, a storage device 552, a communication interface 553, and a bus 554 connecting them.

The CPU 551 controls the entire conveyor control device 550. The CPU 551 executes processing based on a program stored in the storage device 552 or the like to realize a function of the conveyor control device 550 shown in FIG. 4A or FIG. 4B.

The storage device 552 is a storage medium such as a RAM, a ROM, or an HDD, and stores the program or temporarily stores data used by the CPU 551.

The communication interface 553 controls communication between the conveyor control device 550 and the main control device 500 or the conveyor 300.

Hardware configurations of the rolling speed control device 570 and the rolling gap control device 580 are the same as that of the conveyor control device 550. For example, a CPU of the rolling gap control device 580 executes processing based on a program stored in a storage device or the like of the rolling gap control device 580 to realize a function of the rolling gap control device or the like.

Functional Configuration

Figure 3:
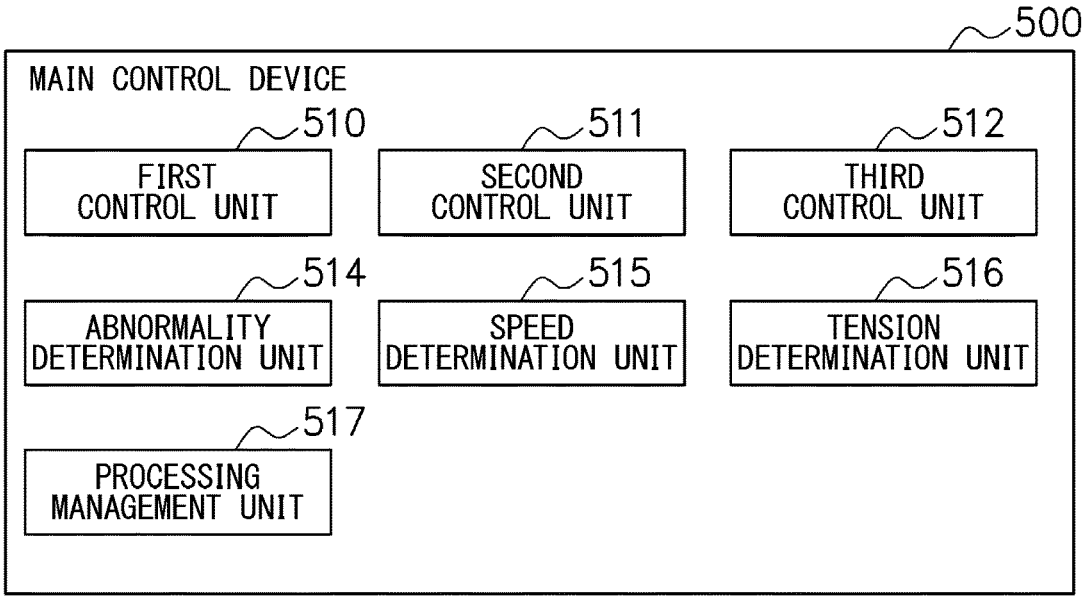
FIG. 3 is a diagram showing an example of a functional configuration of the main control device.

Next, a functional configuration of the main control device 500 will be described with reference to FIG. 3. FIG. 3 is a diagram showing an example of the functional configuration of the main control device 500. The main control device 500 includes a first control unit 510, a second control unit 511, a third control unit 512, an abnormality determination unit 514, a speed determination unit 515, a tension determination unit 516, and a processing management unit 517.

The first control unit 510 controls the rolling gap control device 580 to perform a rolling control and controls the conveyor control device 550 to perform a tension control. The rolling control and the tension control will be described below.

The second control unit 511 controls the rolling gap control device 580 to perform an open control and controls the conveyor control device 550 to perform a speed control in a case where determination is made that there is an abnormality in the steel sheet 10 when the rolling control and the tension control started by the control by the first control unit 510 are performed. The open control and the speed control will be described below.

The third control unit 512 controls the conveyor control device 550 to resume the tension control and controls the rolling gap control device 580 to resume the rolling control in a case where determination is made that the first pinch roll speed is stabilized at a first speed and the second pinch roll speed is stabilized at a second speed by the speed control started by the control by the second control unit 511.

The first speed and the second speed are speeds set in advance according to characteristics of the casting and rolling equipment 100 or the like. The first speed and the second speed may be the same speed. The first speed and the second speed are, for example, the casting roll speeds at the time of casting and rolling in the casting and rolling equipment 100.

The abnormality determination unit 514 determines that there is the abnormality in the steel sheet 10 in a case where determination is made that the steel sheet 10 meanders or a case where determination is made that there is an abnormal sheet thickness fluctuation in the steel sheet 10 or a combination thereof. An example of the abnormal sheet thickness fluctuation in the steel sheet 10 is a hot band described below.

The speed determination unit 515 determines that the first pinch roll speed is stabilized at the first speed in a case where the first pinch roll speed continuously falls in a first speed range during a first speed determination time. The speed determination unit 515 determines that the second pinch roll speed is stabilized at the second speed in a case where the second pinch roll speed continuously falls in a second speed range during a second speed determination time.

The first speed range is a range of speed including the first speed. The second speed range is a range of speed including the second speed. Appropriate values of the first speed range, the second speed range, the first speed determination time, and the second speed determination time for the casting and rolling equipment 100 are determined by a simulation, an experiment, or the like.

The tension determination unit 516 determines that rear surface tension of the first conveyor 300A is stabilized at first tension in a case where the rear surface tension of the first conveyor 300A continuously falls in a first tension range during a first tension determination time. The tension determination unit 516 determines that rear surface tension of the second conveyor 300B is stabilized at second tension in a case where the rear surface tension of the second conveyor 300B continuously falls in a second tension range during a second tension determination time.

The first tension and the second tension are set in advance according to a type of the steel sheet 10, an amount of rolling, or the like. The first tension range is a range of tension including the first tension. The second tension range is a range of tension including the second tension. Appropriate values of the first tension range, the second tension range, the first tension determination time, and the second tension determination time for the casting and rolling equipment 100 are determined by a simulation, an experiment, or the like.

Rear surface tension of the conveyor 300 is tension of the steel sheet 10 on a rear side of the conveyor 300 (advancing direction side of the steel sheet 10). For example, the rear surface tension of the first conveyor 300A is tension between the first pinch roll 301A and the second pinch roll 301B, which is a roll on a rear side of the first pinch roll 301A. The rear surface tension of the second conveyor 300B is tension between the second pinch roll 301B and the rolling roll 351 which is a roll on a rear side of the second pinch roll 301B. The rear surface tension of the conveyor 300 is also referred to as rear surface tension of the pinch roll 301. The rear surface tension of the first conveyor 300A and the rear surface tension of the second conveyor 300B are also respectively referred to as rear surface tension of the first pinch roll 301A and rear surface tension of the second pinch roll 301B.

The processing management unit 517 controls each function included in the main control device 500 or the like.

Next, the functional configuration of the conveyor control device 550 will be described. The conveyor control device 550 has a conveyor control unit. The conveyor control unit controls the conveyor 300 by any one of the controls including the tension control and the speed control. The conveyor control unit includes a tension control unit 560 that performs the tension control and a speed control unit 561 that performs the speed control. The conveyor control unit may be configured such that the conveyor 300 can be controlled by a control other than the tension control and the speed control.

Figure 4A:
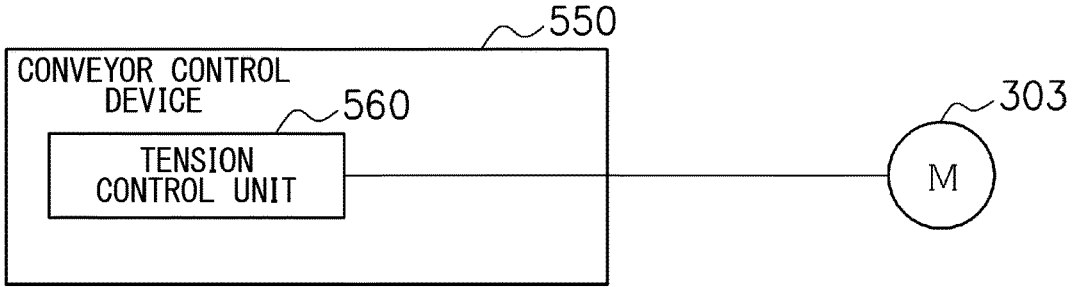
FIG. 4A is a diagram for describing a tension control.

First, the tension control performed by the tension control unit 560 will be described with reference to FIG. 4A. FIG. 4A is a diagram for describing the tension control.

The tension control is a control for the tension control unit 560 to convey the steel sheet 10 with the rear surface tension of the pinch roll 301 as setting tension which is set tension. The tension control unit 560 of the conveyor control device 550 performs the tension control, so that the conveyor 300 conveys the steel sheet 10 with the rear surface tension of the pinch roll 301 as the setting tension. The tension control unit 560 of the first conveyor control device 550A uses the first tension already described as the setting tension. The tension control unit 560 of the second conveyor control device 550B uses the second tension already described as the setting tension.

The tension control performed by the tension control unit 560 will be described in more detail.

As first processing, the tension control unit 560 determines a torque limit based on the setting tension. The torque limit is an upper limit of the torque of the conveyance motor 303 controlled by the tension control unit 560. The tension control unit 560 controls the torque of the conveyance motor 303 so as not to exceed the determined torque limit.

Next, as second processing, the tension control unit 560 controls the conveyance motor 303 such that the pinch roll speed of the pinch roll 301 corresponding to the conveyance motor 303 controlled by the tension control unit 560 is slower than a roll speed of the roll adjacent to the rear side by a differential speed command. The tension control unit 560 is assumed to acquire the differential speed command in advance from the main control device 500.

With the second processing, the pinch roll speed of the pinch roll 301 corresponding to the conveyance motor 303 controlled by the tension control unit 560 becomes slower than the roll speed of the roll adjacent to the rear side by the differential speed command Therefore, the torque of the conveyance motor 303 controlled by the tension control unit 560 gradually increases, and finally the torque of the conveyance motor 303 becomes constant at the torque limit determined in the first processing. This torque limit corresponds to the setting tension. Therefore, when the torque of the conveyance motor 303 reaches the torque limit, the tension of the steel sheet 10 is stabilized at the setting tension. However, the tension control unit 560 may perform the tension control by a method other than the tension control described here.

Figure 4B:
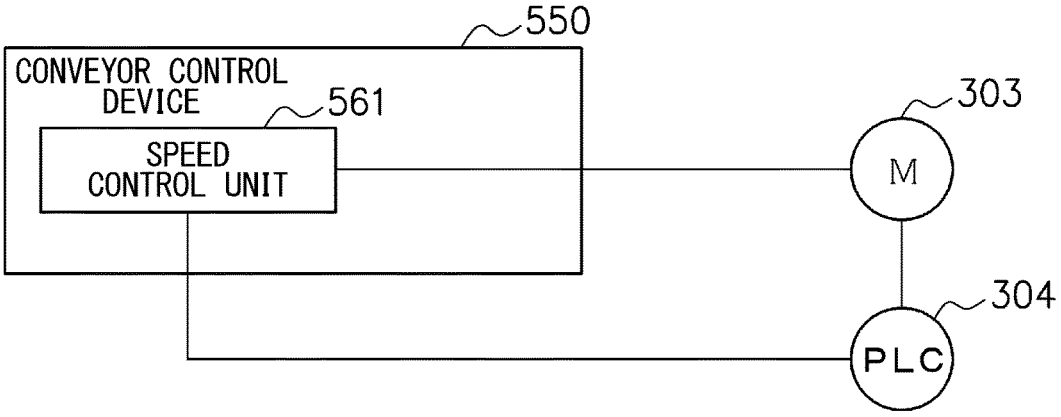
FIG. 4B is a diagram for describing a speed control.

Next, the speed control performed by the speed control unit 561 will be described with reference to FIG. 4B. FIG. 4B is a diagram for describing the speed control.

The speed control is a control for the conveyor 300 to convey the steel sheet 10 with the pinch roll speed as a setting speed which is a set speed. The speed control unit 561 of the conveyor control device 550 controls the speed, so that the conveyor 300 conveys the steel sheet 10 with the pinch roll speed as the setting speed. The speed control unit 561 of the first conveyor control device 550A uses the first speed already described as the setting speed. The speed control unit 561 of the second conveyor control device 550B uses the second speed already described as the setting speed.

The speed control performed by the speed control unit 561 will be described in more detail.

The speed control unit 561 calculates an actual value of the pinch roll speed based on the rotation speed of the conveyance motor 303 acquired from the conveyor speedometer 304.

Next, the speed control unit 561 determines the current flowing through the conveyance motor 303 such that the pinch roll speed approaches the setting speed, based on a difference between the actual value of the pinch roll speed and the setting speed.

Next, the speed control unit 561 controls such that the determined current flows through the conveyance motor 303.

By repeating the processing, the speed control unit 561 controls the conveyor 300 to convey the steel sheet 10 with the pinch roll speed as the setting speed.

Next, a functional configuration of the rolling speed control device 570 will be described. The rolling speed control device 570 includes a speed control unit. The speed control unit of the rolling speed control device 570 controls the rolling motor 354 such that the rolling mill 350 conveys the steel sheet 10 with the rolling roll speed as a set rolling roll speed, using the same control method as the speed control unit 561 of the conveyor control device 550.

Next, a functional configuration of the rolling gap control device 580 will be described. The rolling gap control device 580 has a rolling mill control unit. The rolling mill control unit controls the rolling mill 350 by any one of controls including the rolling control, the open control, and a light reduction control. The rolling mill control unit includes a rolling control unit that performs the rolling control, an open control unit that performs the open control, and a light reduction control unit that performs a light reduction control. The rolling mill control unit may be configured such that the rolling mill 350 can be controlled by a control other than the rolling control, the open control, and the light reduction control.

The rolling control unit performs the rolling control that controls the rolling mill power cylinder 353 of the rolling mill 350 to roll the steel sheet 10 with the rolling roll gap as a first rolling roll gap. When the rolling control is performed, the tension control is performed by the tension control unit 560 in the conveyor control device 550. This is to stably perform the rolling by applying the set tension to the steel sheet 10 when the steel sheet 10 is rolled by the rolling control, for example. The first rolling roll gap is set in advance as a rolling parameter.

The open control unit performs the open control that controls the rolling mill power cylinder 353 such that at least one of the pair of rolling rolls 351 does not contact the steel sheet 10. The state where at least one of the pair of rolling rolls 351 does not contact the steel sheet 10 is referred to as roll opening.

The light reduction control unit performs the light reduction control that controls the rolling mill power cylinder 353 of the rolling mill 350 such that the steel sheet 10 is lightly reduced with the rolling roll gap as a second rolling roll gap. The second rolling roll gap is a value larger than the first rolling roll gap.

Hot Band

Figure 5A:
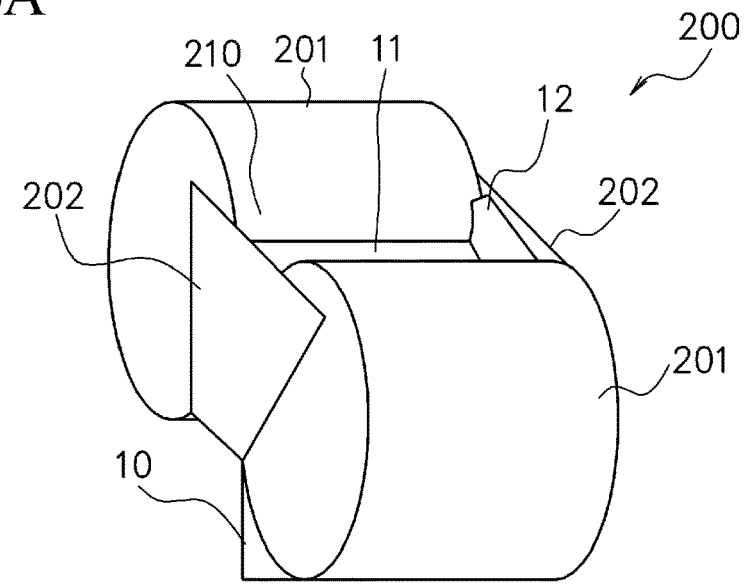
FIG. 5A is a perspective view of an example of a casting portion of a twin roll-type continuous casting machine.
Figure 5B:
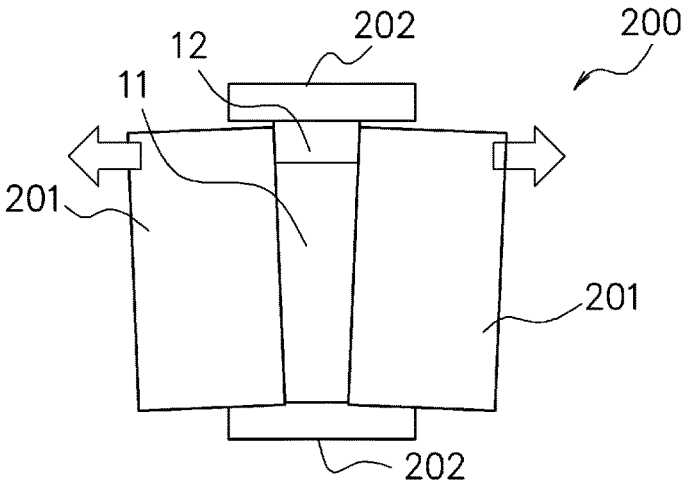
FIG. 5B is a plan view of an example of the casting portion.
Figure 5C:
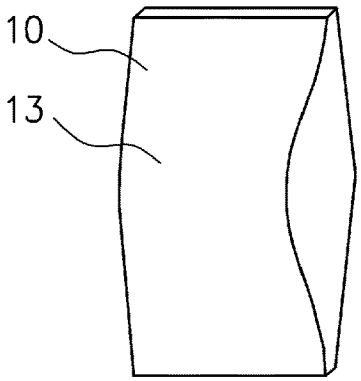
FIG. 5C is a perspective view of an example of a steel sheet on which a hot band is formed.

Next, a hot band 13 of the steel sheet 10, which is an example of the abnormal sheet thickness fluctuation of the steel sheet 10, will be described with reference to FIGS. 5A, 5B, and 5C. FIG. 5A is a perspective view of an example of the casting portion 200 of the twin roll-type continuous casting machine 150. FIG. 5B is a plan view of an example of the casting portion 200. FIG. 5C is a perspective view of an example of the steel sheet 10 on which the hot band 13 is formed.

As shown in FIG. 5C, the hot band 13 is a thick portion of the steel sheet 10 formed by a base metal 12 on a side surface of the weir 202 entering during the casting. The base metal 12 on the side surface of the weir 202 as shown in FIG. 5A is formed by solidifying molten steel 11 adhering to the side surface of the weir 202 due to a fluctuation in a molten metal surface level (surface height of the molten steel 11) during the casting or the like.

The base metal 12 on the side surface of the weir 202 may be peeled off from the weir 202 due to an end portion on a lower side of the base metal 12 being caught in the casting roll 201 or the like, and may enter between the pair of casting rolls 201 as shown in FIG. 5B. When the base metal 12 enters between the pair of casting rolls 201, a space between the pair of casting rolls 201 is widened due to hardness of the base metal 12, and the steel sheet 10 on which the hot band 13 is formed is discharged from the twin roll-type continuous casting machine 150 as shown in FIG. 5C.

For example, in a normal continuous casting machine having a tundish, a mold, and a plurality of rolls and in which molten steel discharged from the tundish is cooled through the mold and conveyed to the plurality of rolls to manufacture a steel sheet, a powder having a function as a heat insulating material is put into the mold. This powder flows between the mold and a solidified shell and also acts as a lubricant. Therefore, an amount of base metal adhering to a side surface of the mold due to the fluctuation in the molten metal surface level is small. On the other hand, in the twin roll-type continuous casting machine, rapid cooling is generally required. Therefore, the powder having the function as the heat insulating material and the lubricant is not input. Therefore, the lubricity is inferior to that of a normal continuous casting machine. Therefore, in the twin roll-type continuous casting machine, an amount of adhesion of the base metal 12 on the side surface of the weir 202 is larger than the amount of adhesion of the base metal on the side surface of the mold in the normal continuous casting machine. Therefore, in the case of the twin roll-type continuous casting machine, the hot band 13 is generally likely to be formed.

Detection Method of Hot Band Occurrence

Figure 6:
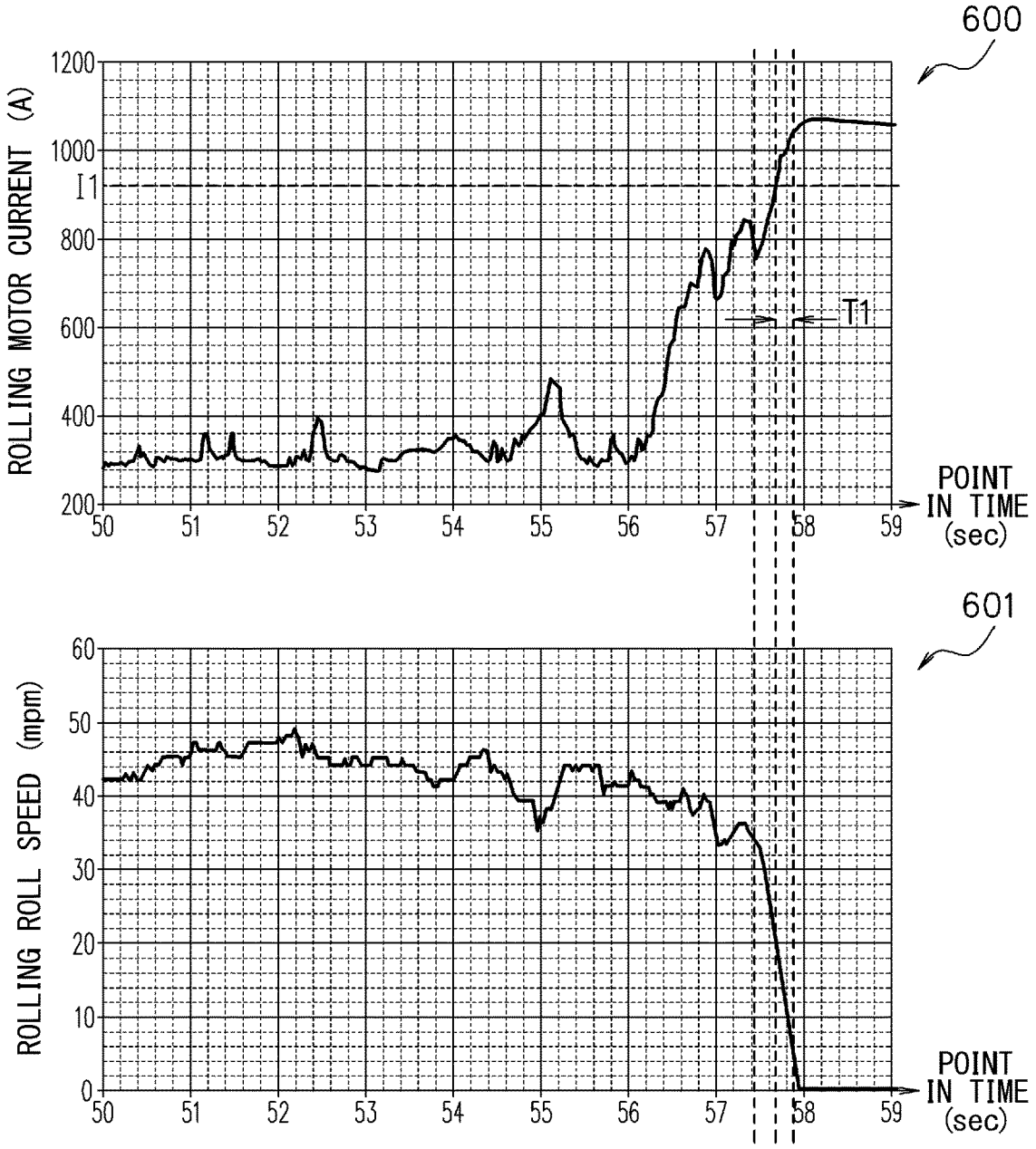

Next, a detection method of hot band occurrence will be described with reference to FIG. 6. FIG. 6 is a diagram showing a rolling motor current graph 600 and a rolling roll speed graph 601.

The rolling motor current graph 600 of FIG. 6 shows a time change of the current flowing through the rolling motor 354 when the casting and rolling system 1 actually performs the casting and the rolling. The rolling roll speed graph 601 of FIG. 6 shows a time change of the rolling roll speed when the casting and rolling system 1 actually performs the casting and the rolling. In the rolling roll speed graph 601, the rolling roll speed is represented in units of mpm (meters/minute). When data of FIG. 6 is acquired, the rolling speed control device 570 controls the speed control unit to perform the speed control and the rolling gap control device 580 controls the rolling control unit to perform the rolling control. In the rolling motor current graph 600, the hot band 13 of the steel sheet 10 reaches the rolling roll 351 at a point in time of about 57.4 (sec).

As can be seen from the rolling motor current graph 600, when the hot band 13 of the steel sheet 10 reaches the rolling roll 351, the current of the rolling motor 354 increases and reaches an upper limit. As can be seen from the rolling roll speed graph 601, after the hot band 13 of the steel sheet 10 reaches the rolling roll 351, the rolling roll speed becomes 0 (zero) and the conveyance of the steel sheet 10 is stopped in the rolling mill 350.

It is considered that this is partly because the rolling speed control device 570 and the rolling gap control device 580 operate as follows. When the hot band 13 reaches the rolling roll 351, force in a direction of increasing the rolling roll gap is added to the rolling roll 351. In this case, the rolling control unit of the rolling gap control device 580 controls the upper rolling roll 351 to reduce the steel sheet 10 with strong force by the rolling mill power cylinder 353 in order to set the rolling roll gap to the first rolling roll gap. The speed control unit of the rolling speed control device 570 controls to maintain the rolling roll speed. However, since the upper rolling roll 351 reduces the steel sheet 10 with a strong force, the speed control unit of the rolling speed control device 570 increases the current of the rolling motor 354 to increase the torque of the rolling motor 354 in order to maintain the rolling roll speed. In this manner, the current of the rolling motor 354 reaches the upper limit. Finally, the torque of the rolling motor 354 cannot be increased and the rolling roll 351 cannot withstand the force of reducing the steel sheet 10. Therefore, and the rolling roll speed becomes 0 (zero).

As shown in the rolling motor current graph 600, when the hot band 13 of the steel sheet 10 reaches the rolling roll 351, the current of the rolling motor 354 increases and reaches the upper limit. From the above, in a case where the current of the rolling motor 354 continuously exceeds a current threshold value I1 during a hot band determination time T1, it can be determined that the hot band 13 reaches the rolling motor 354. The current threshold value I1 is a threshold value of a current used for the determination for the hot band 13. The current threshold value I1 is a current that does not flow through the rolling motor 354 during normal rolling and is a current flowing through the rolling motor 354 after the hot band 13 reaches the rolling roll 351. The current threshold value I1 is set in advance based on the rolling motor current graph 600. The hot band determination time T1 is set in advance in order to prevent erroneous determination.

Roll Opening

Next, a necessity of the roll opening at the time of hot band occurrence will be described with reference to the rolling roll speed graph 601 of FIG. 6. As described above, when the hot band 13 of the steel sheet 10 reaches the rolling roll 351 and then the rolling control unit of the rolling gap control device 580 continues the rolling control, the rolling roll speed becomes 0 (zero) and the conveyance of the steel sheet 10 is stopped in the rolling mill 350. In a case where the hot band 13 reaches the rolling roll 351, the roll opening is performed and it waits for the hot band 13 to pass through the rolling roll 351. Accordingly, it is possible to avoid the rolling roll speed from becoming 0 (zero).

Amount of Wedge

Figure 7:
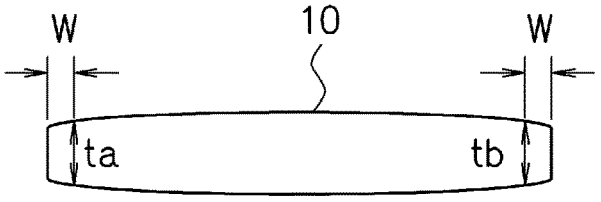
FIG. 7 is a cross-sectional view of an example of the steel sheet.

Next, an amount of wedge of the steel sheet 10 will be described with reference to FIG. 7. FIG. 7 is a cross-sectional view of an example of the steel sheet 10.

The amount of wedge of the steel sheet 10 is a difference in the thickness of both end portions of the steel sheet 10. The amount of wedge of the steel sheet 10 is defined by the following equation (1).

$$\text{Amount of wedge} = |ta - tb| \quad (1)$$

Here, ta is a thickness of the steel sheet 10 at a position w (mm) from one end portion in the width direction of the steel sheet 10. tb is a thickness of the steel sheet 10 at a position w (mm) from the other end portion in the width direction of the steel sheet 10. For example, 25 (mm) is used as w (mm).

In the twin roll-type continuous casting machine 150, the molten steel is changed to a sheet-shaped steel sheet 10 by the pair of casting rolls 201. In the twin roll-type continuous casting machine 150, the amount of wedge tends to be large since there are many unstable operating elements such as easy occurrence of the hot band, compared with the normal continuous casting machine.

When the steel sheet 10 having a large amount of wedge passes through the rolling roll 351, a rolling reduction difference occurs between one end portion and the other end portion in the width direction of the steel sheet 10 having the large amount of wedge according to the sheet thickness control and a speed difference occurs between one end portion and the other end portion in the width direction. This speed difference causes the meandering. Therefore, in a case where the twin roll-type continuous casting machine 150, which tends to have a large amount of wedge, is used, the speed difference tends to be large and the meandering tends to be larger than in a case where the normal continuous casting machine is used. When the steel sheet 10 meanders, the steel sheet 10 contacts an instrument or the like, which causes the instrument or the like to break down or the steel sheet 10 to defect.

In a case where the meandering of the steel sheet 10 occurs, the roll opening is performed and it waits for a portion of the steel sheet 10 having the large amount of wedge to pass through the rolling roll 351. Therefore, it is possible to avoid the instrument or the like from breaking down due to the meandering of the steel sheet 10.

Tension Control at Time of Roll Opening

Figure 8A:
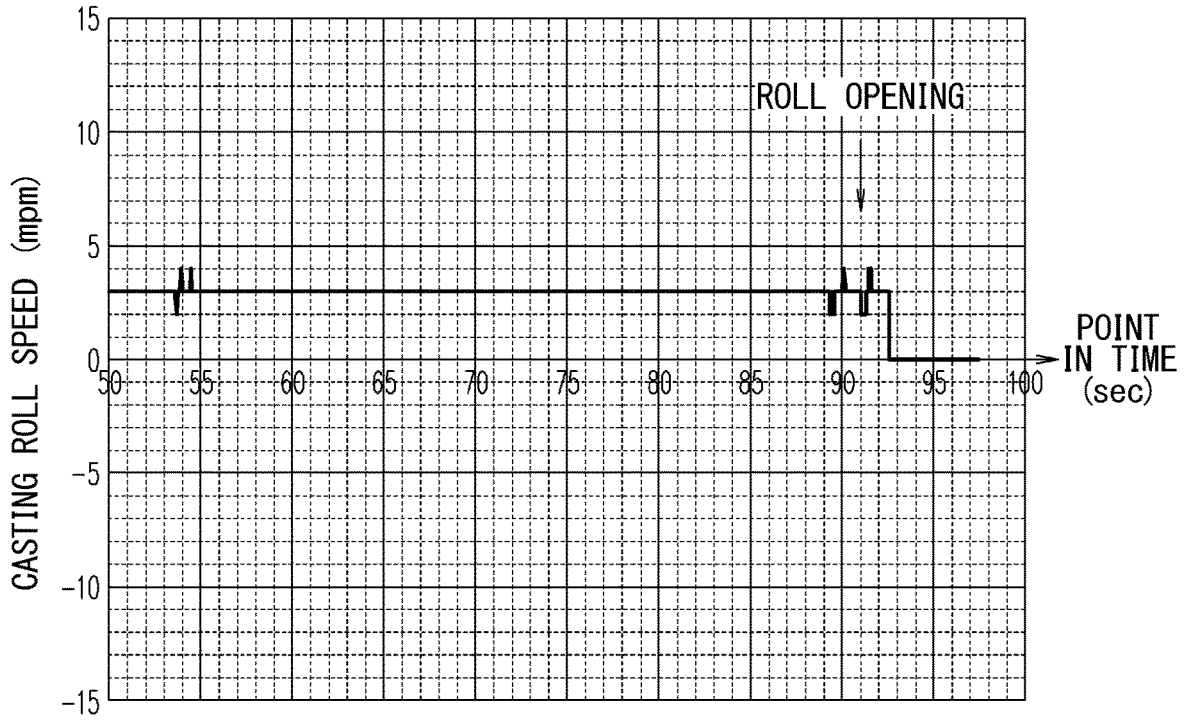
FIG. 8A is a diagram showing a casting roll speed graph.
Figure 8B:
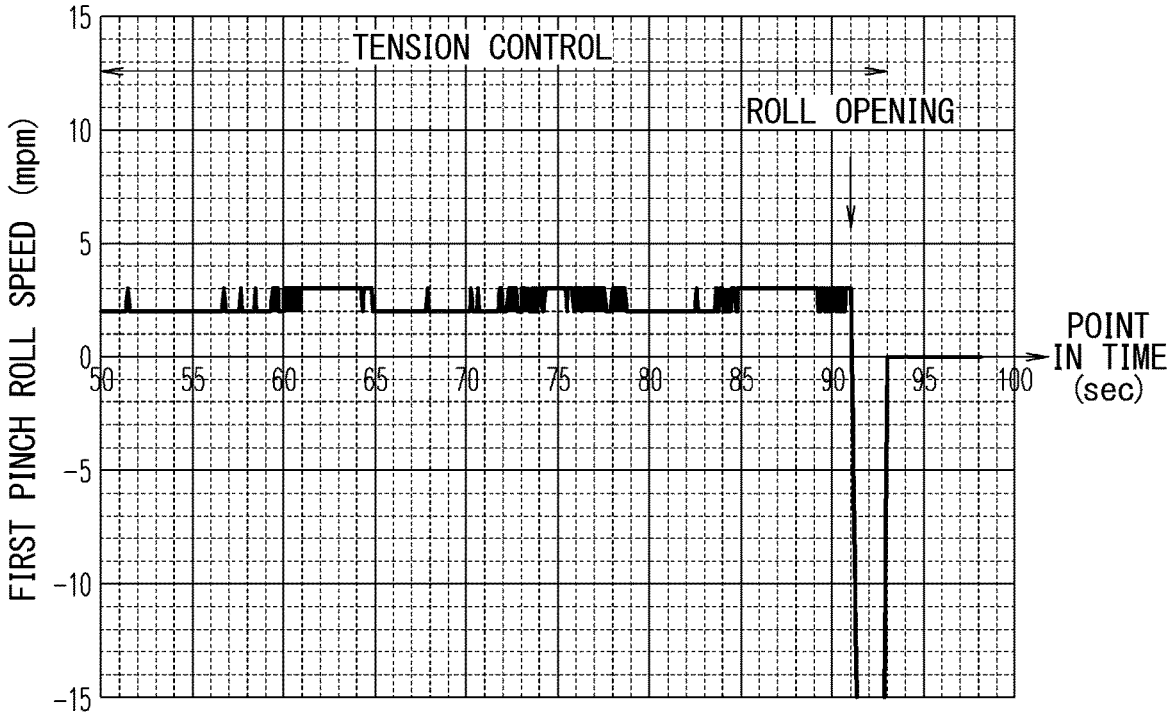
FIG. 8B is a diagram showing a first pinch roll speed graph.
Figure 8C:
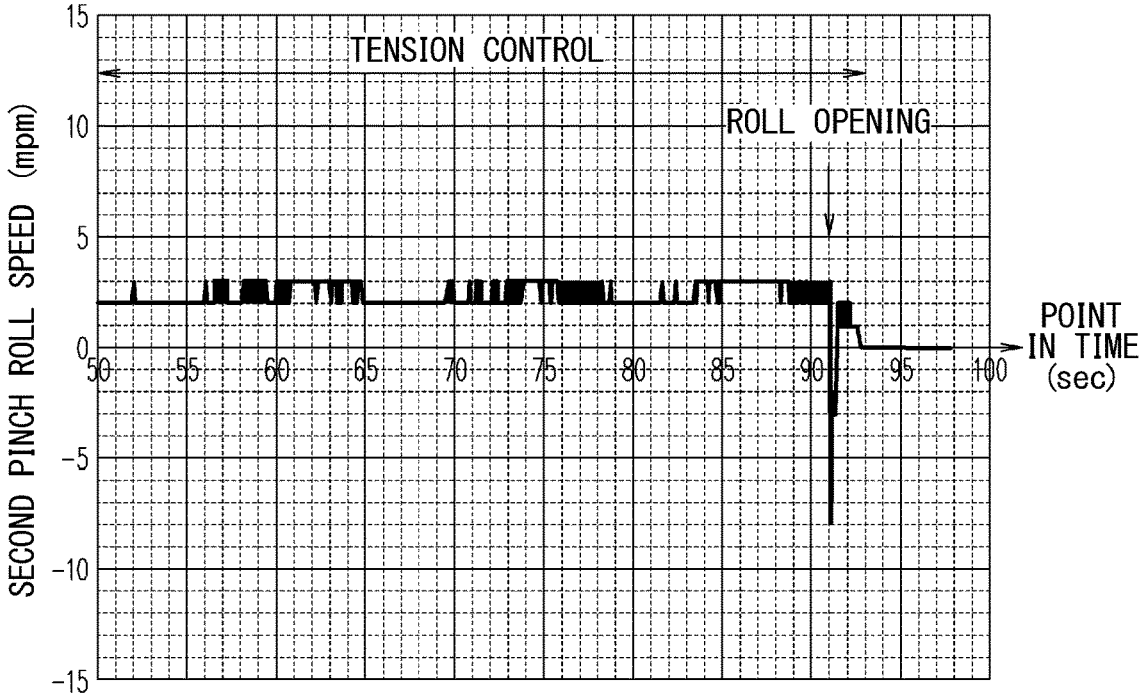
FIG. 8C is a diagram showing a second pinch roll speed graph.
Figure 8D:
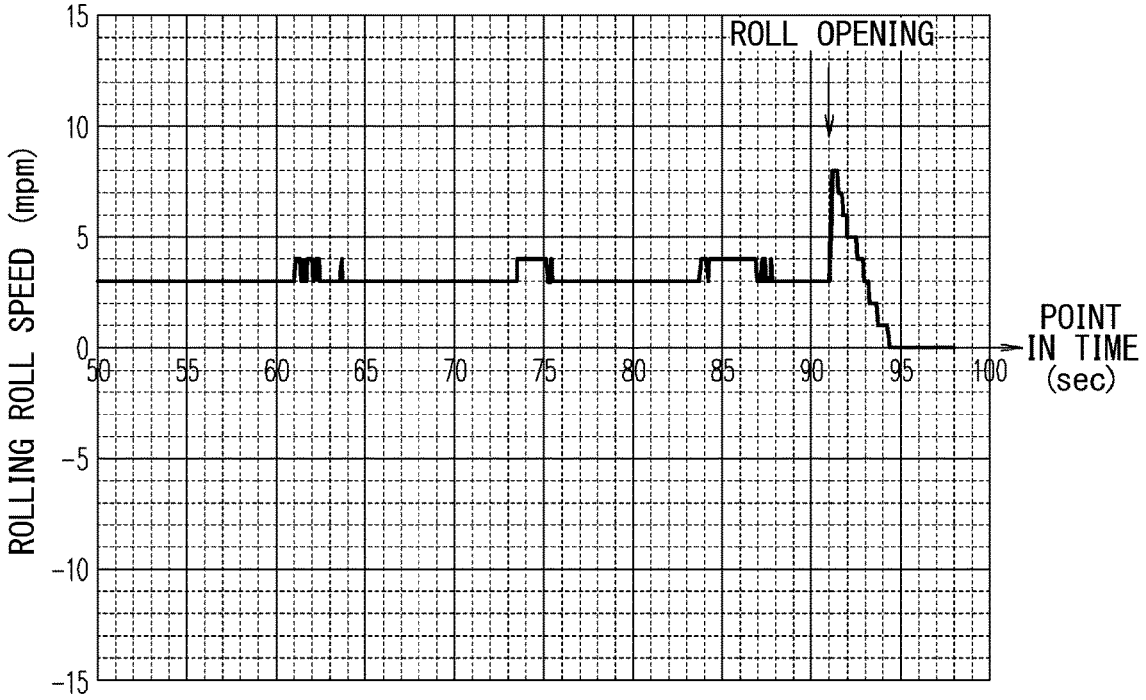
FIG. 8D is a diagram showing a rolling roll speed graph.

Next, an operation of a casting and rolling system as a comparative example in a case where the roll opening is performed when the tension control is performed will be described with reference to FIGS. 8A to 8D. FIG. 8A is a diagram showing a casting roll speed graph representing a time change of the casting roll speed. FIG. 8B is a diagram showing a first pinch roll speed graph representing a time change of the first pinch roll speed. FIG. 8C is a diagram showing a second pinch roll speed graph representing a time change of the second pinch roll speed. FIG. 8D is a diagram showing a rolling roll speed graph representing the time change of the rolling roll speed. The casting and rolling system as the comparative example has the same configuration as the casting and rolling system 1 according to the present embodiment. However, unlike an operation of the casting and rolling system 1 according to the present embodiment which will be described below with reference to FIG. 9, the conveyor control device 550 only performs the tension control in the casting and rolling system as the comparative example.

Data of FIGS. 8A to 8D are obtained when the casting and the rolling are actually performed using the casting and rolling system as the comparative example. In the casting and rolling system as the comparative example, the tension control unit 560 of the first conveyor control device 550A and the tension control unit 560 of the second conveyor control device 550B perform the tension control. In the casting and rolling system as the comparative example, the rolling control unit of the rolling gap control device 580 performs the rolling control. However, at a point in time of about 91 (sec), the rolling control unit of the rolling gap control device 580 stops the rolling control and the open control unit of the rolling gap control device 580 starts the open control to perform the roll opening. Even after the roll opening is performed, the tension control unit 560 continues the tension control.

As will be described below, at a point in time of about 93 (sec), the operation of the casting and rolling system 1 is stopped in the casting and rolling system as the comparative example.

As shown in FIGS. 8A to 8D, the casting roll speed, the first pinch roll speed, the second pinch roll speed, and the rolling roll speed are substantially the same speed until the roll opening is performed. Therefore, it can be said that a sheet slip of the steel sheet 10 does not occur. The sheet slip of the steel sheet 10 is a state where the steel sheet 10 is slipped on the roll such as the pinch roll 301.

The casting roll speed and the rolling roll speed are maintained at positive values even when the roll opening is performed, as shown from the point in time of about 91 (sec) to the point in time of about 93 (sec) in FIGS. 8A and 8D. In FIGS. 8A to 8D, the roll opening is performed at the point in time of about 91 (sec). On the other hand, the first pinch roll speed and the second pinch roll speed suddenly change to negative values when the roll opening is performed, as shown near the point in time of about 91 (sec) in FIGS. 8B and 8C. The fact that the first pinch roll speed and the second pinch roll speed are the negative values represents that the first pinch roll 301A and the second pinch roll 301B rotate in a reverse direction to convey the steel sheet 10 in a direction opposite to the direction of the rolling mill 350. Here, it is considered that the steel sheet 10 is conveyed at a speed close to the casting roll speed in the casting and rolling equipment 100 and is always conveyed in the direction of the rolling mill 350 when viewed from the pinch roll 301 in a time zone before and after the roll opening. At a moment when the first pinch roll 301A and the second pinch roll 301B rotate in the reverse direction at the point in time of about 91 (sec) when the roll opening is performed, the steel sheet 10 is not suddenly conveyed in the opposite direction along with the reverse rotation. Therefore, it can be said that the sheet slip of the steel sheet 10 occurs in the first pinch roll 301A and the second pinch roll 301B.

It is considered that the following operation causes the sheet slip of the steel sheet 10 to occur due to the roll opening. That is, the tension of the steel sheet 10 fluctuates greatly due to the roll opening. At this time, the tension control unit 560 continues the tension control even after the roll opening. Therefore, the tension control unit 560 of the first conveyor control device 550A greatly changes the torque of the first conveyance motor 303A in order to maintain the tension of the steel sheet 10 to the first tension. Accordingly, a rotation speed of the first conveyance motor 303A fluctuates greatly. As a result, the sheet slip of the steel sheet 10 occurs in the first pinch roll 301A. Similarly, the sheet slip of the steel sheet 10 occurs also in the second pinch roll 301B.

As can be seen from the first pinch roll speed graph of FIG. 8B, when the sheet slip of the steel sheet 10 occurs due to the roll opening, the sheet slip of the steel sheet 10 continues and the sheet slip of the steel sheet 10 is not eliminated in the first pinch roll 301A. Therefore, as shown in FIGS. 8A to 8D, the casting roll speed, the first pinch roll speed, the second pinch roll speed, and the rolling roll speed are all 0 (zero) at the latest at a point in time of time 95 (sec) to stop the operation of the casting and rolling system 1.

When the sheet slip of the steel sheet 10 occurs, it is impossible to perform the tension control and to normally roll the steel sheet 10. The roll may defect due to the sheet slip of the steel sheet 10. Therefore, even in a case where the sheet slip of the steel sheet 10 occurs when the roll opening is performed, it is necessary to eliminate the sheet slip of the steel sheet 10 in a short time.

Control Processing

Figure 9:
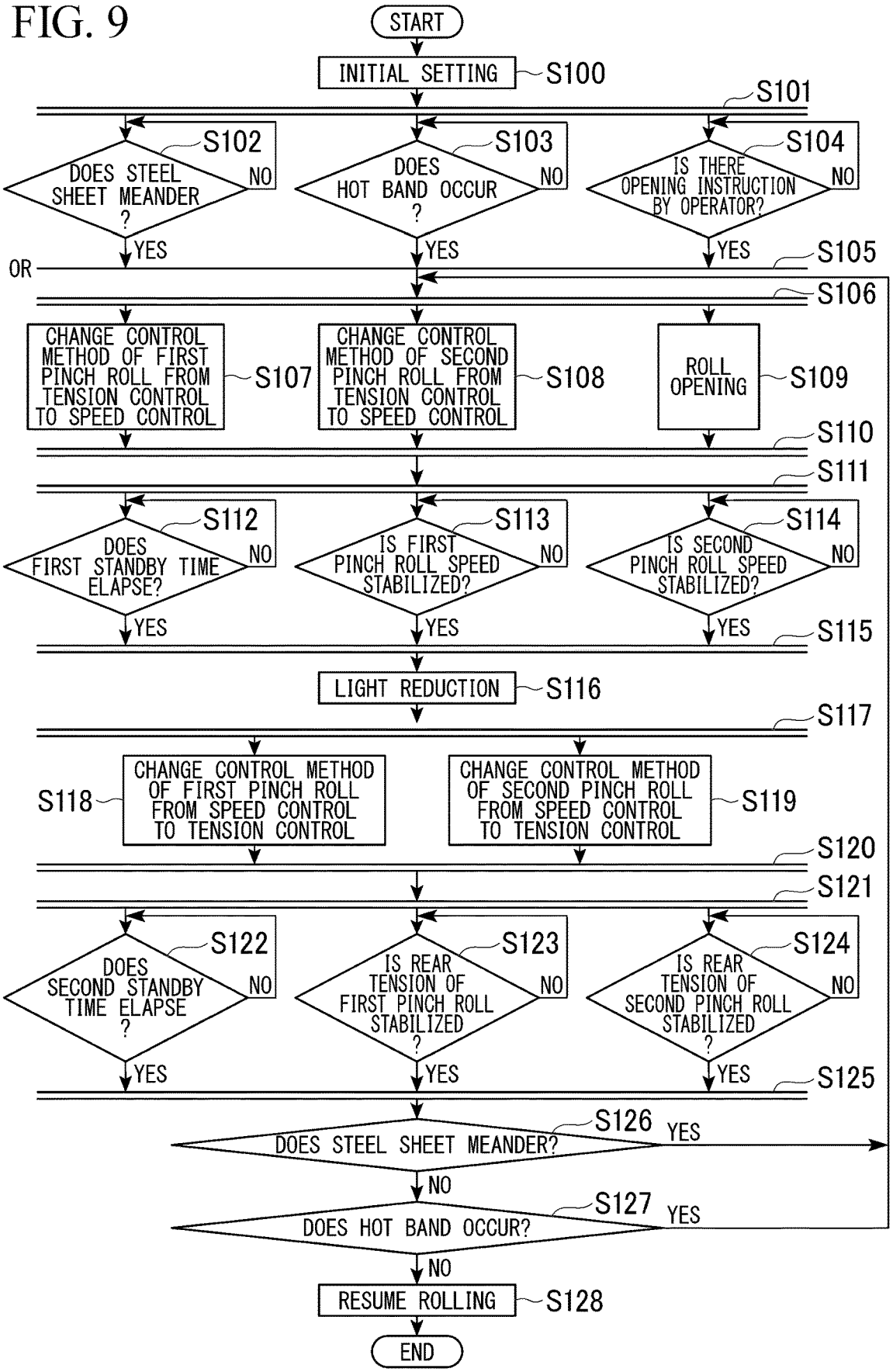
FIG. 9 is a flowchart showing an example of control processing.

Next, control processing according to the present embodiment will be described with reference to FIG. 9. FIG. 9 is a flowchart showing an example of the control processing. With the control processing according to this embodiment, it is possible to eliminate the sheet slip of the steel sheet 10 in a short time. The control processing of FIG. 9 is executed by the main control device 500.

In S100, the processing management unit 517 refers to the storage device 502 or receives information from an external device by network communication to acquire various parameters of the casting and rolling equipment 100. The processing management unit 517 performs an initial setting such that the casting and rolling equipment 100 performs an operation corresponding to the acquired various parameters. The various parameters acquired by the processing management unit 517 include the first tension, the first tension range, the first tension determination time, the second tension, the second tension range, the second tension determination time, the first speed, the first speed range, the first speed determination time, the second speed, the second speed range, the second speed determination time, the first rolling roll gap, the second rolling roll gap, and the like.

The first control unit 510 controls the casting and rolling equipment 100 to perform the casting and the rolling. At this time, the first control unit 510 transmits a command to the rolling gap control device 580 through the communication interface 503 to control the rolling control unit of the rolling gap control device 580 to perform the rolling control. The first control unit 510 transmits a command to the first conveyor control device 550A and the second conveyor control device 550B through the communication interface 503 to control the tension control unit 560 of the first conveyor control device 550A to perform the tension control and to control the tension control unit 560 of the second conveyor control device 550B to perform the tension control. The first control unit 510 transmits a command to the rolling speed control device 570 through the communication interface 503 to control the speed control unit of the rolling speed control device 570 to perform the speed control.

In S101, the processing management unit 517 controls to start processing of S102, S103, and S104 in parallel.

In S102, the abnormality determination unit 514 determines whether or not the steel sheet 10 meanders based on the amount of meandering acquires from the meandering meter 254. The abnormality determination unit 514 determines that the steel sheet 10 meanders in a case where the amount of meandering continuously exceeds a meandering amount range during a meandering determination time. The meandering amount range is determined in advance by an experiment or the like as a range that satisfies a condition such as non-contact of the steel sheet 10 with the instrument or the like. The meandering determination time is for preventing erroneous detection of the meandering of the steel sheet 10 and is determined in advance by an experiment, a simulation, or the like. The abnormality determination unit 514 advances the processing to S105 in a case where determination is made that the steel sheet 10 meanders, and executes S102 again in a case where determination is made that the steel sheet 10 does not meander.

In S103, the abnormality determination unit 514 determines whether or not the hot band 13 occurs based on the current flowing through the rolling motor 354. As already described above, the abnormality determination unit 514 determines that the hot band 13 occurs in the case where the current of the rolling motor 354 continuously exceeds the current threshold value 11 during the hot band determination time T1. The abnormality determination unit 514 may acquire the current flowing through the rolling motor 354 from the rolling speed control device 570 or may acquire the current from an ammeter that measures the current of the rolling motor 354. The abnormality determination unit 514 advances the processing to S105 in a case where determination is made that the hot band 13 occurs, and executes S103 again in a case where determination is made that the hot band 13 does not occur.

In S104, the abnormality determination unit 514 determines whether or not the operator performs an opening instruction based on an operation of the operator received by the input device 504 included in the main control device 500, the information received from the external device, or the like. The abnormality determination unit 514 advances the processing to S105 in a case where determination is made that the operator performs the opening instruction and executes S104 again in a case where determination is made that the operator does not perform the opening instruction.

In S105, the abnormality determination unit 514 advances the processing to S106 in a case where the processing advances to S105 from S102, S103, or S104 or any combination thereof. The processing management unit 517 controls to stop the processing of S102, S103, and S104 in execution in a case where the processing advances to S105 and in a case where the processing of S102, S103, or S104 or any combination thereof is executed.

In S106, the processing management unit 517 controls to start processing of S107, S108, and S109 in parallel.

In S107, the second control unit 511 controls to change a control method of the first pinch roll 301A from the tension control to the speed control. More specifically, the second control unit 511 transmits a command to the first conveyor control device 550A through the communication interface 503 to control the speed control unit 561 of the first conveyor control device 550A to start the speed control. Thereafter, the second control unit 511 advances the processing to S110.

In S108, the second control unit 511 controls to change a control method of the second pinch roll 301B from the tension control to the speed control. More specifically, the second control unit 511 transmits a command to the second conveyor control device 550B through the communication interface 503 to control the speed control unit 561 of the second conveyor control device 550B to start the speed control. Thereafter, the second control unit 511 advances the processing to S110.

In S109, the second control unit 511 controls to perform the roll opening. More specifically, the second control unit 511 transmits a command to the rolling gap control device 580 through the communication interface 503 to control the open control unit of the rolling gap control device 580 to start the open control. Accordingly, the roll opening is performed. Thereafter, the second control unit 511 advances the processing to S110.

In S110, the processing management unit 517 advances the processing to S111 after the processing of S107, S108, and S109 ends.

In S111, the processing management unit 517 controls to start processing of S112, S113, and S114 in parallel.

In S112, the speed determination unit 515 determines whether or not a first standby time elapses since the processing of S107 is performed. The first standby time is a time from when the roll opening is performed and the speed control is started until the first pinch roll speed and the second pinch roll speed are stabilized by the speed control and is set by performing an experiment or a simulation in advance. The first standby time is indicated as TFr in FIGS. 10B and 10C described below. The speed determination unit 515 advances the processing to S115 in a case where the processing of S107 is performed and then determination is made that the first standby time elapses, and executes S112 again in a case where determination is made that the first standby time does not elapse.

In S113, the speed determination unit 515 determines whether or not the first pinch roll speed is stabilized at the first speed. As already described above, the speed determination unit 515 determines that the first pinch roll speed is stabilized at the first speed in a case where the first pinch roll speed continuously falls in the first speed range during the first speed determination time. The speed determination unit 515 acquires the first pinch roll speed from, for example, the first conveyor control device 550A. The speed determination unit 515 advances the processing to S115 in a case where determination is made that the first pinch roll speed is stabilized at the first speed, and executes S113 again in a case where determination is made that the first pinch roll speed is not stabilized at the first speed. The first speed, the first speed range, and the first speed determination time are respectively indicated as V1, R1, and TV1 in FIG. 10B, which will be described below.

In S114, the speed determination unit 515 determines whether or not the second pinch roll speed is stabilized at the second speed. As already described above, the speed determination unit 515 determines that the second pinch roll speed is stabilized at the second speed in a case where the second pinch roll speed continuously falls in the second speed range during the second speed determination time.

The speed determination unit 515 acquires the second pinch roll speed from, for example, the second conveyor control device 550B. The speed determination unit 515 advances the processing to S115 in a case where determination is made that the second pinch roll speed is stabilized at the second speed, and executes S114 again in a case where determination is made that the second pinch roll speed is not stabilized at the second speed. The second speed, the second speed range, and the second speed determination time are respectively indicated as V2, R2, and TV2 in FIG. 10C, which will be described below.

In the above S112, S113, and S114, the speed determination unit 515 performs processing of waiting until the first pinch roll speed and the second pinch roll speed are stabilized by the speed control.

In S115, the processing management unit 517 advances the processing to S116 after the processing of S112, S113, and S114 end.

In S116, the third control unit 512 transmits a command to the rolling gap control device 580 through the communication interface 503 to control the light reduction control unit of the rolling gap control device 580 to start the light reduction control. Accordingly, the rolling miii 350 starts the processing of lightly reducing the steel sheet 10. It is considered that an abnormal portion of the steel sheet 10 such as the hot band 13 of the steel sheet 10 or the portion of the steel sheet 10 having the large amount of wedge, which causes the meandering of the steel sheet 10, passes through the rolling roll 351 during a period from when the roll opening is performed in S109 until the light reduction is started in S116. In a case where the abnormal portion of the steel sheet 10 remains during the period from when the roll opening is performed in S109 until the light reduction is started in S116, S109 and subsequent processing are executed again after processing of S126 or S127, and S116 is executed after the roll opening is performed and the pinch roll speed is stabilized. Therefore, finally all the abnormal portions of the steel sheet 10 pass through the rolling roll 351.

In S117, the processing management unit 517 controls to start the processing of S118 and S119 in parallel.

In S118, the third control unit 512 controls to change the control method of the first pinch roll 301A from the speed control to the tension control. More specifically, the third control unit 512 transmits a command to the first conveyor control device 550A through the communication interface 503 to control the tension control unit 560 of the first conveyor control device 550A to start the tension control. Thereafter, the third control unit 512 advances the processing to S120.

In S119, the third control unit 512 controls to change the control method of the second pinch roll 301B from the speed control to the tension control. More specifically, the third control unit 512 transmits a command to the second conveyor control device 550B through the communication interface 503 to control the tension control unit 560 of the second conveyor control device 550B to start the tension control. Thereafter, the third control unit 512 advances the processing to S120.

In S120, the processing management unit 517 advances the processing to S121 after the processing of S118 and S119 ends.

In S121, the processing management unit 517 controls to start processing of S122, S123, and S124 in parallel.

In S122, the tension determination unit 516 determines whether or not a second standby time elapses since the processing of S118 is performed. The second standby time is a time from the tension control is started until the rear surface tension of the first pinch roll 301A and the rear surface tension of the second pinch roll 301B are stabilized and is set by performing an experiment or a simulation in advance. The tension determination unit 516 advances the processing to S125 in a case where the processing of S118 is performed and then determination is made that the second standby time elapses, and executes S122 again in a case where determination is made that the second standby time does not elapse.

In S123, the tension determination unit 516 determines whether or not the rear surface tension of the first pinch roll 301A is stabilized at the first tension. As already described above, the tension determination unit 516 determines that the rear surface tension of the first pinch roll 301A is stabilized at the first tension in a case where the rear surface tension of the first pinch roll 301A is continuously in the first tension range during the first tension determination time. The tension determination unit 516 calculates and uses the rear surface tension of the first pinch roll 301A based on, for example, an output of an ammeter that measures the current of the first conveyance motor 303A. The tension determination unit 516 advances the processing to S125 in a case where determination is made that the rear surface tension of the first pinch roll 301A is stabilized at the first tension, and executes S123 again in a case where determination is made that the rear surface tension of the first pinch roll 301A is not stabilized at the first tension.

In S124, the tension determination unit 516 determines whether or not the rear surface tension of the second pinch roll 301B is stabilized at the second tension. As already described above, the tension determination unit 516 determines that the rear surface tension of the second pinch roll 301B is stabilized at the second tension in a case where the rear surface tension of the second pinch roll 301B is continuously in the second tension range during the second tension determination time. The tension determination unit 516 calculates and uses the rear surface tension of the second pinch roll 301B based on, for example, an output of an ammeter that measures the current of the second conveyance motor 303B. The tension determination unit 516 advances the processing to S125 in a case where determination is made that the rear surface tension of the second pinch roll 301B is stabilized at the second tension, and executes S124 again in a case where determination is made that the rear surface tension of the second pinch roll 301B is not stabilized at the second tension.

In S122, S123, and S124 described above, the tension determination unit 516 performs processing of waiting until the tension of the steel sheet 10 is stabilized by the tension control.

In S125, the processing management unit 517 advances the processing to S126 after the processing of S122, S123, and S124 ends.

In S126, the abnormality determination unit 514 determines whether or not the steel sheet 10 meanders based on the amount of meandering acquired from the meandering meter 254 in the same manner as in S102. The abnormality determination unit 514 returns the processing to S106 in a case where determination is made that the steel sheet 10 meanders, and advances the processing to S127 in a case where determination is made that the steel sheet 10 does not meander.

In S127, the abnormality determination unit 514 determines whether or not the hot band 13 occurs based on the current flowing through the rolling motor 354 in the same manner as in S103. The abnormality determination unit 514 returns the processing to S106 in a case where determination is made that the hot band 13 occurs, and advances the processing to S128 in a case where determination is made that the hot band 13 does not occur.

In S128, the third control unit 512 transmits a command to the rolling gap control device 580 through the communication interface 503 to control the rolling control unit of the rolling gap control device 580 to resume the rolling control. Accordingly, the rolling mill 350 resumes the processing of rolling the steel sheet 10. Thereafter, the processing management unit 517 ends the processing of FIG. 9.

Operation Example

Figure 10A:
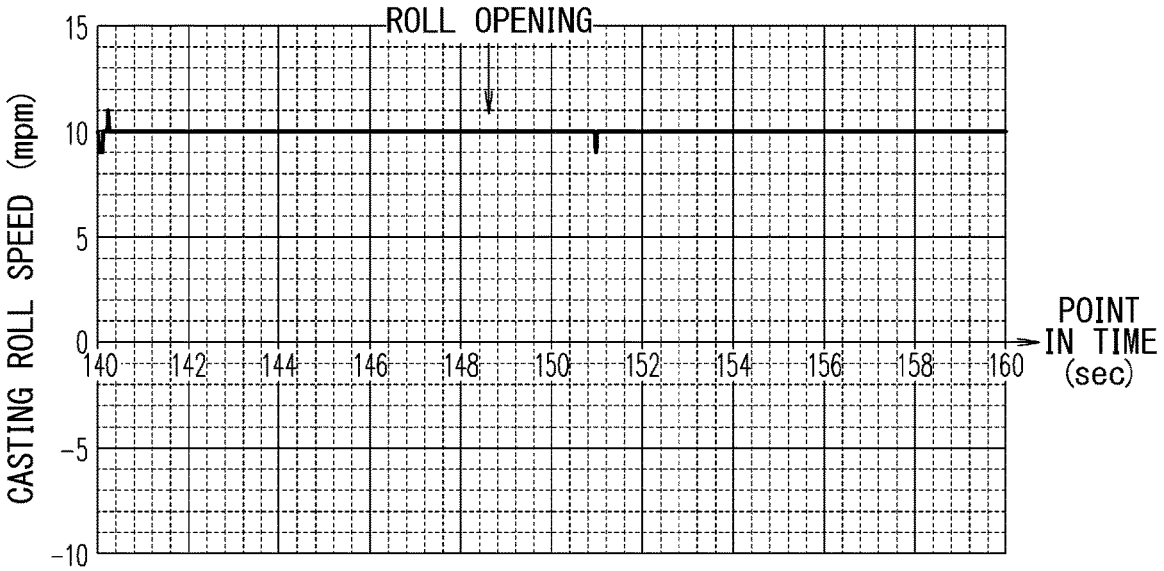
FIG. 10A is a diagram showing the casting roll speed graph.
Figure 10B:
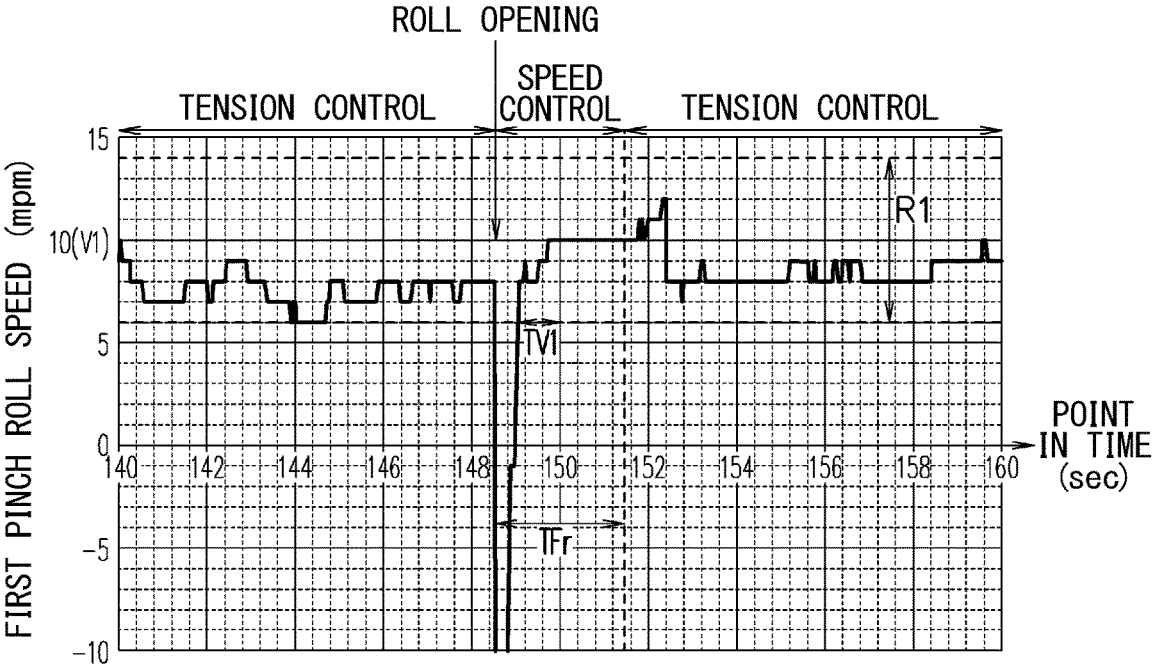
FIG. 10B is a diagram showing the first pinch roll speed graph.
Figure 10C:
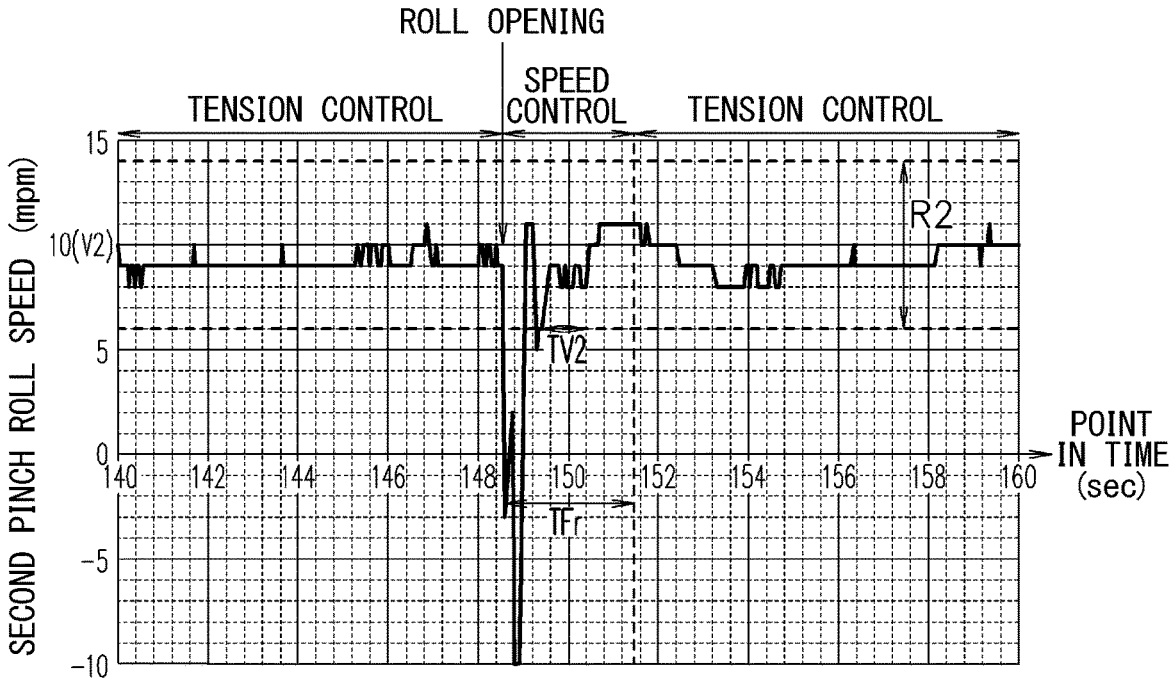
FIG. 10C is a diagram showing the second pinch roll speed graph.
Figure 10D:
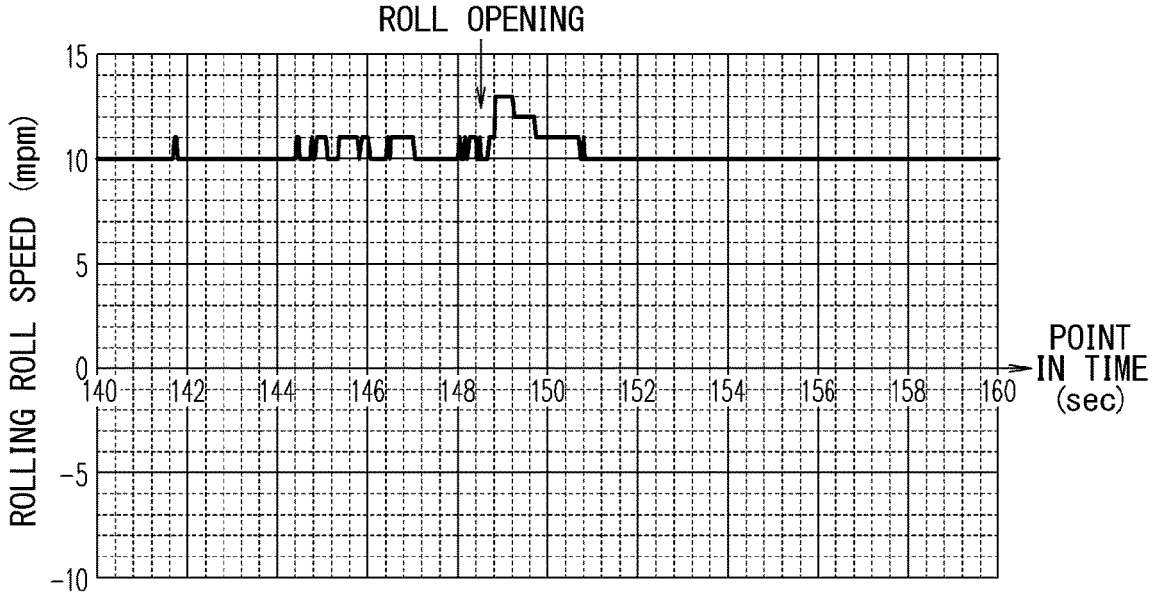
FIG. 10D is a diagram showing the rolling roll speed graph.

Next, an operation example of the control processing of FIG. 9 will be described with reference to FIGS. 10A to 10D. FIG. 10A is a diagram showing the casting roll speed graph representing the time change of the casting roll speed. FIG. 10B is a diagram showing the first pinch roll speed graph representing the time change of the first pinch roll speed. FIG. 10C is a diagram showing the second pinch roll speed graph representing the time change of the second pinch roll speed. FIG. 10D is a diagram showing the rolling roll speed graph representing the time change of the rolling roll speed.

The V1, R1, and TV1 in FIG. 10B are respectively the first speed, the first speed range, and the first speed determination time already described. The V2, R2, and TV2 in FIG. 10C are respectively the second speed, the second speed range, and the second speed determination time already described. The TFr in FIGS. 10B and 10C is the first standby time already described.

In the operation example shown in FIGS. 10A to 10D, the operator performs the opening instruction, and the roll opening is performed by the processing of S109 in FIG. 9 at a point in time of about 148.6 (sec). At this time, a control method of the pinch roll 301 is changed from the tension control to the speed control in S107 and S108 in FIG. 9, as shown in the first pinch roll speed graph of FIG. 10B and the second pinch roll speed graph 622 of FIG. 10C.

Thereafter, in a case where determination is made that the pinch roll speed is stabilized by the speed control in the processing of S112, S113, and S114, the control method of the pinch roll 301 is changed from the speed control to the tension control in S118 and S119.

The casting roll speed and the rolling roll speed are maintained at positive values before and after the roll opening, as shown near the point in time of about 148.5 (sec) when the roll opening is performed in FIGS. 10A and 10D. On the other hand, the first pinch roll speed and the second pinch roll speed suddenly change before and after the roll opening is performed and change from positive values to negative values, as shown near the point in time of about 148.5 (sec) when the roll opening is performed in FIGS. 10B and 10C. Therefore, it can be said that the sheet slip of the steel sheet 10 occurs in the first pinch roll 301A and the second pinch roll 301B immediately after the roll opening is performed, as in the operation example described with reference to FIGS. 8A to 8D.

However, with the start of the speed control at the time of the roll opening, the first pinch roll speed and the second pinch roll speed become the same speeds as the casting roll speed and the rolling roll speed within 0.5 (sec) after the roll opening. Therefore, it can be said that the sheet slip of the steel sheet 10 is eliminated within 0.5 (sec) after the roll opening.

Thereafter, even after the tension control is started, the first pinch roll speed and the second pinch roll speed are maintained at the same speeds as the casting roll speed and the rolling roll speed. Therefore, normal rolling is possible.

As described above, the sheet slip of the steel sheet 10 is eliminated in a short time by the control processing of FIG. 9, even in a case where the roll opening is performed. It is possible to resume the normal rolling even after the roll opening is performed in the casting and rolling system 1 according to the present embodiment, unlike the operation of the casting and rolling system as the comparative example described with reference to FIGS. 8A to 8D.

Effect

When the rolling is continued in a case where the abnormality occurs in the steel sheet 10, the rolling roll speed becomes 0 (zero) which causes the rolling to stop, or the steel sheet 10 contacts the instrument or the like due to the meandering of the steel sheet 10 which causes the instrument or the like to break down, as already described above. When the end portion of the steel sheet 10 in the width direction contacts the instrument or the like due to the meandering of the steel sheet 10, the steel sheet 10 may be bent which causes the rolling not to be continued. Therefore, unsteady work such as work for resuming the rolling or work for repairing the instrument or the like is required. For this reason, it is impossible to continue the rolling of the steel sheet 10 stably.

On the other hand, in the present embodiment, the roll opening is performed by the open control in a case where the abnormality occurs in the steel sheet 10. Therefore, it is possible to avoid the rolling from stopping or the instrument or the like from breaking down, and it is possible to continue the rolling of the steel sheet 10 stably.

When the tension control is continued in a case where the roll opening is performed, the sheet slip of the steel sheet 10 occurs in the pinch roll 301 as already described above. The sheet slip continues without being eliminated. Therefore, the pinch roll 301 defects, and unsteady work such as replacement of the pinch roll 301 is required. As a result, it is necessary to stop the rolling. Therefore, it is impossible to continue the rolling of the steel sheet 10 stably. When the sheet slip of the steel sheet 10 continues, it is impossible to perform the tension control and thus roll the steel sheet 10 normally.

On the other hand, in the present embodiment, the control method of the pinch roll 301 is changed from the tension control to the speed control after the roll opening. Therefore, it is possible to eliminate the sheet slip of the steel sheet 10 and thus suppress the occurrence of unsteady work such as replacement of the pinch roll 301, as already described above. Therefore, it is possible to continue the rolling of the steel sheet 10 stably.

In the present embodiment, the third control unit 512 controls the rolling gap control device 580 to resume the rolling control after the conveyor control device 550 resumes the tension control. Therefore, the rolling is automatically resumed. Therefore, it is possible to continue the rolling of the steel sheet 10 stably.

The twin roll-type continuous casting machine 150 discharges the steel sheet 10 to the conveyor 300. Here, when the rolling is continued in a case where the abnormality occurs in the steel sheet 10, the rolling is stopped as described above. For this reason, it is impossible to convey the steel sheet 10 and it is necessary to stop the twin roll-type continuous casting machine 150. In a case where the twin roll-type continuous casting machine 150 is used, the manufacturing of the steel sheet is continuously performed from the twin roll-type continuous casting machine 150 to the winding of the steel sheet 10 after hot rolling, and the molten steel is in between the pair of casting rolls 201 and is rapidly cooled. Therefore, the molten steel between the pair of casting rolls 201 has a high solid proportion in a solid-liquid coexistence state. When the twin roll-type continuous casting machine 150 is stopped in this state, the molten steel solidifies in the pouring basin 210 or between the pair of casting rolls 201. It is necessary to clean the pouring basin 210 and to check and clean a sticking state of the steel between the pair of casting rolls 201 in order to remove the solidified molten steel, and it takes a lot of time for such unsteady work. However, in the present embodiment, even in a case where the abnormality occurs in the steel sheet 10, the conveyance of the steel sheet 10 is not stopped. Therefore, the unsteady work to remove the solidified molten steel is unnecessary. Therefore, it is possible to continue the rolling of the steel sheet 10 stably.

The third control unit 512 controls the rolling gap control device 580 to perform the light reduction control and then controls to resume the tension control. Therefore, when the tension control is resumed, the rolling roll 351 lightly reduces the steel sheet 10. Therefore, it is possible to apply the tension to the steel sheet 10 between the pinch roll 301 and the rolling roll 351 by the tension control.

In a case where it is determined that there is the abnormality in the steel sheet 10 after the tension control is resumed by the control by the third control unit 512, the second control unit 511 controls the rolling gap control device 580 to perform the open control and controls the conveyor control device 550 to perform the speed control. Therefore, the rolling control is not resumed until the abnormality in the steel sheet 10 is eliminated. Therefore, when the rolling control is resumed, it is possible to reliably perform the normal rolling.

The abnormality determination unit 514 determines that there is the abnormality in the steel sheet 10 in the case where determination is made that the steel sheet 10 meanders or the case where determination is made that there is the abnormal sheet thickness fluctuation in the steel sheet 10 or a combination thereof. Therefore, it is possible to reliably detect the usually assumed abnormality in the steel sheet 10 in the casting and rolling system 1.

The abnormality determination unit 514 determines whether or not the hot band 13 occurs in the steel sheet 10 based on the current of the rolling motor 354. Therefore, it is possible to perform simple processing for determining the occurrence of the hot band 13.

The speed determination unit 515 determines that the first pinch roll speed is stabilized at the first speed in a case where the first pinch roll speed is continuously in the first speed range during the first speed determination time. The speed determination unit 515 determines that the second pinch roll speed is stabilized at the second speed in a case where the second pinch roll speed is continuously in the second speed range during the second speed determination time. Therefore, it is possible to prevent erroneous detection that the pinch roll speed is stabilized.

Modification Example

In the above embodiment, the tension determination unit 516 controls the rear surface tension of the conveyor 300. However, the tension determination unit 516 may be configured to control front tension of the conveyor 300. The front tension is tension of the steel sheet 10 on a front side (side opposite to the advancing direction of the steel sheet 10) of the conveyor 300.

The casting and rolling equipment 100 includes two conveyors 300, but the conveyor 300 may be one or three or more.

In the above embodiment, the main control device 500 includes the input device 504. However, the conveyor control device 550 may include an input device that receives an input from the operator. The conveyor control device 550 transmits information indicating that the opening instruction is received to the main control device 500 in a case where the opening instruction by the operator is received through the input device. In S104 in FIG. 9, the abnormality determination unit 514 of the main control device 500 determines that the operator performs the opening instruction based on the information received from the conveyor control device 550. The rolling speed control device 570 or the rolling gap control device 580 or a combination thereof may include an input device that receives an input from the operator.

Although the present invention has been described above together with the embodiments, the above embodiments are merely examples of embodiment of the present invention, and the technical scope of the present invention should not be interpreted in a limited manner by the embodiments. That is, the present invention can be implemented in various forms without departing from the technical idea or the main features thereof.

INDUSTRIAL APPLICABILITY

According to the present invention, it is possible to continue the rolling stably.

BRIEF DESCRIPTION OF THE REFERENCE SYMBOLS

1: casting and rolling system
100: casting and rolling equipment
101: control system
150: twin roll-type continuous casting machine
300: conveyor
350: rolling mill
400: looper
450: coiler
500: main control device
550: conveyor control device
570: rolling speed control device
580: rolling gap control device

The invention claimed is:

1. A control system of casting and rolling equipment including a twin roll-type continuous casting machine, a rolling mill that rolls a steel sheet with a pair of rolling rolls, and a conveyor that conveys the steel sheet in a direction of the rolling mill with a pair of conveyance rolls, in which the twin roll-type continuous casting machine includes a pair of casting rolls that rotates in directions opposite to each other, the pair of the casting rolls cools molten steel injected into an upper pouring basin between the pair of the casting rolls and pressure-contacts the cooled and solidified molten steel to discharge the steel sheet from between the pair of the casting rolls, and the conveyor conveys the steel sheet discharged from the twin roll-type continuous casting machine in the direction of the rolling mill, the control system comprising:

a rolling mill control unit configured to control the rolling mill by any one of controls including a rolling control of rolling the steel sheet with a set roll gap and an open control that performs a control such that at least one of the pair of the rolling rolls does not contact the steel sheet;

a conveyor control unit configured to control the conveyor by any one of controls including a tension control that conveys the steel sheet at set tension of the steel sheet and a speed control that conveys the steel sheet at a set rotation speed of the conveyance rolls;

a first control unit configured to control the rolling mill control unit to perform the rolling control and controls the conveyor control unit to perform the tension control;

a second control unit configured to control the rolling mill control unit to perform the open control and controls the conveyor control unit to perform the speed control in a case where determination is made that there is an abnormality in the steel sheet while the rolling control and the tension control started by the control by the first control unit are performed; and a third control unit configured to control the conveyor control unit to resume the tension control and controls the rolling mill control unit to resume the rolling control in a case where determination is made that the conveyance rolls are stabilized at the set rotation speed by the speed control started by the control by the second control unit.

2. The control system according to claim 1, wherein the rolling mill control unit controls the rolling mill by any one of controls including the rolling control, the open control, and a light reduction control that lightly reduces the steel sheet with a roll gap larger than the set roll gap, and the third control unit controls the rolling mill control unit to perform the light reduction control, then controls the conveyor control unit to resume the tension control, and then controls the rolling mill control unit to resume the rolling control, in a case where determination is made that the pair of conveyance rolls is stabilized at the set rotation speed by the speed control started by the control by the second control unit.

3. The control system according to claim 2, wherein the third control unit controls the rolling mill control unit to perform the light reduction control, then controls the conveyor control unit to resume the tension control, and then controls the rolling mill control unit to resume the rolling control in a case where determination is made that there is no abnormality in the steel sheet, in a case where determination is made that the pair of conveyance rolls are stabilized at the set rotation speed by the speed control started by the control by the second control unit, and the second control unit controls the rolling mill control unit to perform the open control and controls the conveyor control unit to perform the speed control, in a case where determination is made that there is an abnormality in the steel sheet after the tension control is resumed by the control by the third control unit or in a case where determination is made that there is an abnormality in the steel sheet while the rolling control and the tension control started by the control by the first control unit are performed.

4. The control system according to claim 1, further comprising:

an abnormality determination unit that determines that there is the abnormality in the steel sheet in a case where determination is made that the steel sheet meanders or a case where determination is made that there is an abnormal sheet thickness fluctuation in the steel sheet or a combination thereof, wherein the second control unit controls the rolling mill control unit to perform the open control and controls the conveyor control unit to perform the speed control, in a case where the abnormality determination unit determines that there is an abnormality in the steel sheet while the rolling control and the tension control started by the control by the first control unit are performed.

5. The control system according to claim 4, wherein the abnormality determination unit determines whether or not the abnormal sheet thickness fluctuation occurs in the steel sheet based on a current of a motor that rotates the rolling roll.

6. The control system according to claim 1, further comprising:

a speed determination unit that determines that the conveyance rolls are stabilized at the set rotation speed in a case where the rotation speed of the conveyance rolls continuously falls in a set range for a set time, wherein the third control unit controls the conveyor control unit to resume the tension control and controls the rolling mill control unit to resume the rolling control, in a case where the speed determination unit determines that the conveyance rolls are stabilized at the set rotation speed after the speed control is started by the control by the second control unit.

7. A control device that controls casting and rolling equipment including a twin roll-type continuous casting machine, a rolling mill that rolls a steel sheet with a pair of rolling rolls, a conveyor that conveys the steel sheet in a direction of the rolling mill with a pair of conveyance rolls, a rolling mill control unit configured to control the rolling mill by any one of controls including a rolling control of rolling the steel sheet with a set roll gap and an open control that performs a control such that at least one of the pair of the rolling rolls does not contact the steel sheet, a conveyor control unit configured to control the conveyor by any one of controls including a tension control that conveys the steel sheet at set tension of the steel sheet and a speed control that conveys the steel sheet at a set rotation speed of the conveyance rolls, in which the twin roll-type continuous casting machine includes a pair of casting rolls that rotates in directions opposite to each other, the pair of the casting rolls cools molten steel injected into an upper pouring basin between the pair of the casting rolls and pressure-contacts the cooled and solidified molten steel to discharge the steel sheet from between the pair of the casting rolls, and the conveyor conveys the steel sheet discharged from the twin roll-type continuous casting machine in the direction of the rolling mill, the control device comprising:

a first control unit configured to control the rolling mill control unit to perform the rolling control and controls the conveyor control unit to perform the tension control;

a second control unit configured to control the rolling mill control unit to perform the open control and controls the conveyor control unit to perform the speed control in a case where determination is made that there is an abnormality in the steel sheet while the rolling control and the tension control started by the control by the first control unit are performed; and a third control unit configured to control the conveyor control unit to resume the tension control and controls the rolling mill control unit to resume the rolling control in a case where determination is made that the conveyance rolls are stabilized at the set rotation speed by the speed control started by the control by the second control unit.

* * * * *